US005895877A

United States Patent [19]

Tamura

[11] Patent Number: 5,895,877

[45] Date of Patent: Apr. 20, 1999

[54] TONE GENERATING METHOD AND DEVICE

[75] Inventor: Motoichi Tamura, Hamamatsu, Japan

[73] Assignee: Yamaha Corporation, Hamamatsu, Japan

[21] Appl. No.: 08/649,168

[22] Filed: May 17, 1996

[30] Foreign Application Priority Data

| | | | |
|---|---|---|---|
| May 19, 1995 | [JP] | Japan | 7-144159 |
| Sep. 20, 1995 | [JP] | Japan | 7-264629 |
| Jan. 17, 1996 | [JP] | Japan | 8-023323 |

[51] Int. Cl.[6] ..... G10H 1/08; G10H 1/18; G10H 7/00

[52] U.S. Cl. ..... 84/625; 84/602; 84/603; 84/604; 84/622; 84/660

[58] Field of Search ..... 84/602, 603–607, 84/622–625, 645, 659–660; 364/130, 194

[56] References Cited

U.S. PATENT DOCUMENTS

| | | | |
|---|---|---|---|
| 4,373,416 | 2/1983 | Endo et al. . | |
| 4,984,497 | 1/1991 | Inagaki et al. | 84/626 |
| 5,007,323 | 4/1991 | Usami . | |
| 5,038,661 | 8/1991 | Kaneko . | |
| 5,086,475 | 2/1992 | Kutaragi et al. . | |
| 5,107,747 | 4/1992 | Saito | 84/655 |
| 5,121,667 | 6/1992 | Emery et al. . | |
| 5,200,564 | 4/1993 | Usami et al. . | |
| 5,218,155 | 6/1993 | Saito | 84/623 |
| 5,248,842 | 9/1993 | Saito | 84/602 |
| 5,276,273 | 1/1994 | Takauji . | |
| 5,283,386 | 2/1994 | Akutsu et al. | 84/603 |
| 5,300,724 | 4/1994 | Medovich . | |
| 5,317,947 | 6/1994 | Mitata . | |
| 5,319,151 | 6/1994 | Shiba et al. . | |
| 5,331,111 | 7/1994 | O'Connell . | |
| 5,376,752 | 12/1994 | Limberis et al. . | |
| 5,428,183 | 6/1995 | Matsuda et al. . | |
| 5,432,293 | 7/1995 | Nonaka et al. . | |
| 5,448,009 | 9/1995 | Kudo . | |
| 5,508,469 | 4/1996 | Kunimoto et al. . | |
| 5,522,010 | 5/1996 | Toyama . | |
| 5,553,011 | 9/1996 | Fujita . | |
| 5,567,900 | 10/1996 | Higashi . | |
| 5,596,159 | 1/1997 | O'Connell . | |
| 5,604,324 | 2/1997 | Kubota . | |
| 5,613,147 | 3/1997 | Okamura . | |
| 5,614,685 | 3/1997 | Matsumoto . | |
| 5,625,158 | 4/1997 | Ichiki . | |
| 5,726,371 | 3/1998 | Shiba et al. . | |

FOREIGN PATENT DOCUMENTS

| | | |
|---|---|---|
| 0 484 047 | 5/1992 | European Pat. Off. . |
| 0 597 381 | 5/1994 | European Pat. Off. . |
| WO 80/01215 | 6/1980 | WIPO . |

OTHER PUBLICATIONS

"Computer Music Journal", vol. 12, No. 3, Fall 1988, pp. 79–80.

"Computer Music Journal", vol. 13, No. 1, Spring 1989, pp. 36–46.

"Computer Music Journal", vol. 13, No. 4, Winter 1989, pp. 54–64.

Hal Chamberlin, "Musical Applications of Microprocessors", 2nd Ed., Hayden Books, 1987, pp. 639–774.

*Primary Examiner*—William M. Shoop, Jr.
*Assistant Examiner*—Marlon T. Fletcher
*Attorney, Agent, or Firm*—Graham & James LLP

[57] ABSTRACT

For a given tone generating channel, tone waveform sample data corresponding to a plurality of sampling cycles (e.g., 100 samples) are arithmetically formed collectively. Once performance information such as MIDI event data is supplied to a tone generator MIDI driver from an application program such as a MIDI sequencer, the MIDI driver, in response to an input MIDI signal, assigns new tone generation to a designated tone generating channel of a tone generator task, and prepares tone controlling parameters to be set in the designated channel. The tone generator task arithmetically forms tone waveform data by use of the tone controlling parameters and passes the tone waveform data to a CODEC circuit functioning as an A/D converter. The program and a general-purpose operating system are sequenced and executed by a preemptive multitask management program. In this way, it is possible to reduce overheads involved in arithmetically forming tone waveform samples.

36 Claims, 20 Drawing Sheets

( AEG+ VOL+ AM + PAN+ SENDLEVEL )

207 WAVEFORM FORMATION FOR CH(i)

114. WAVEFORM FORMATION FOR 32 CH'S

EXAMPLE OF E G WAVEFORM

L F O WAVEFORM (PHASE WAVEFORM)

TONE GENERATING METHOD AND DEVICE

BACKGROUND OF THE INVENTION

The present invention relates to a tone generating method and device which permit a tone to be formed by a general-purpose processor having a computing unit.

The present invention also relates to a tone generating method which forms a tone waveform by executing a tone generating program on a programmable computing unit such as a CPU or DSP.

Conventionally known tone generating devices in general comprise a MIDI (Musical Instrument Digital Interface), a performance input section for receiving performance information from a keyboard or sequencer, a tone generator section for forming a tone waveform, and a microprocessor or central processing unit (CPU) for controlling the tone generator section in accordance with the input performance information. The CPU performs tone generator driver processing (performance processing) such as assignment of each tone to a selected channel (channel assignment) and parameter conversion in accordance with the input performance information, and supplies the converted parameters and a tone generating instruction (note-on signal) to the channel assigned by the tone generator section. The tone generator section is implemented by an electronic circuit such as an LSI (Large Scale Integrated Circuit) and forms a tone waveform on the basis of the supplied parameters.

However, the known tone generating devices were dedicated to tone generation purposes, and it was absolutely necessary in the past to employ such a dedicated tone generating device in order to generate tones.

For a solution to the problem, an improved tone generating device has been proposed, in which the CPU executes a specific application program to generate tones on the basis of the application program. This tone generating device can be implemented by a general-purpose computing unit which can perform tone generating and other functions by executing not only the tone generating application program but also other application programs. A general-purpose computer such as a personal computer can be employed as the hardware of such a tone generating device, which executes a tone generator program for tone generating operations. In this way, a so-call "software tone generator" is provided by the general-purpose computer.

In cases where tone are generated by executing an application program on a general-purpose device having a computing unit (CPU), it has been customary that tone waveform samples are formed for individual tone generating channels every sampling cycle (i.e., conversion timing of a D/A converter employed). Thus, when the CPU executes necessary operations for each of the tone generating channels, some preparatory operations are performed by the CPU, such as reading, into the CPU registers, of various registers' values used in the last calculations for the channel. Also, after termination of tone generating processing for the channel, it is necessary to write the CPU registers' values into a memory for next execution of the processing.

However, because the tone waveform sample forming or calculating process is performed sample by sample in each of the tone generating channels, the conventional software tone generator would present a problem that much of the CPU's calculating time is spent on the preparatory operations rather than the tone generating process (resulting in increased overheads), so that the calculating efficiency and response and tone forming speed of the tone generator would be undesirably lowered. That is, in performing the tone waveform sample forming process for the individual tone generating channels every sampling cycle, it is necessary for the CPU to cause the various data used in the last calculations for the channels to be restored from the memory to the above-mentioned registers and also, after termination of the waveform forming calculations, cause the registers' stored contents to be saved into the memory for next execution of the process. Thus, much processing time is required for operations other than the primary waveform forming calculations.

Further, in the known tone generating methods where the CPU performs both the tone generator processing and the performance processing, the "performance processing" is one for creating control information for controlling tones to be generated on the basis of input performance information, and the "tone generator processing" is one for forming waveform data on the basis of the created control information. For example, the CPU normally executes the performance processing such as detection of depressed keys while it executes the tone generator processing every sampling cycle in response to an interrupt signal. After formation of waveform data is completed for one sample in the tone generator processing, the CPU reverts to the performance processing.

The performance information (MIDI event information) is generated by a player's performance operation or reproduction of an event via a sequencer, and the generated performance information is processed in the performance processing. Namely, whenever such performance information is generated, the CPU must execute the performance processing in addition to the normal tone generator processing; thus, non-periodic generation of the performance information would lead to a temporary increase in the calculating amounts. However, according to the known tone generating methods which are not arranged to properly deal with such a temporary increase in the calculating amounts, the tone generator processing is preferentially executed in a periodic fashion irrespective of whether performance information has been input or not, so that the performance processing would sometimes be delayed appreciably.

The delay in the performance processing may be avoided by raising the priority of the performance processing; however, in such a case, the operation of the tone generator processing would become instable, causing the number of simultaneously generated tones to be temporarily reduced or a tone waveform to be broken off.

SUMMARY OF THE INVENTION

It is therefore an object of the present invention to provide a tone generating method and device which are capable of reducing overheads of a CPU in a software tone generator system.

It is another object of the present invention to provide a tone generating method which can prevent a temporary increase in the amount of processing.

It is still another object of the present invention to provide a tone generating method which can execute waveform forming calculations in a stable manner, can output waveform data promptly when a waveform reproduction section requests a supply of the waveform data, and can also supply input waveform data during a series of operations of a software tone generator for a tone color controlling process.

It is still another object of the present invention to permit stable tone generator processing even when the amount of processing increases upon occurrence of performance information.

It is still another object of the present invention to minimize the amount of arithmetic operations necessary for waveform formation.

In order to accomplish the above-mentioned objects, a tone generating method according to a first aspect of the present invention comprises a first step of issuing generation instructions to generate a plurality of designated tones, a second step of assigning the designated tones to respective tone generating channels designated from among a plurality of tone generating channels and writing controlling data for the designated tones into channel registers of the respective designated tone generating channels for storage therein, a third step of issuing calculation-start instructions at predetermined intervals, a fourth step of, in response to the calculation-start instructions issued by the third step, sequentially performing tone forming calculations for the designated tone generating channels in response to the calculation-start instructions issued by the third step so as to arithmetically form waveform data for plural samples, for each of the designated tone generating channels, on the basis of the controlling data stored in the channel register of the channel, a fifth step of, for each of the samples, mixing the waveform data formed for the designated tone generating channels by the fourth step so as to form mixed sample data, and a sixth step of converting the mixed sample data for each of the plural samples into an analog signal every sampling cycle. In the tone forming calculations, the fourth step performs, for each of the designated tone generating channels, formation of the waveform data for the plural samples on the basis of one readout of the controlling data from the channel register and write of the controlling data into the channel register after the formation of the waveform data.

The tone generating method may further comprises a seventh step of issuing an on-the-way calculation-start instruction in accordance with the generation instruction issued by the first step for each of the designated tones, so that in in response to the on-the-way calculation-start instruction, the fourth step forms the waveform data for plural samples that correspond to a section from an end point of a last-formed waveform to a time point when the generation instruction is issued by the first step.

Another implementation of the tone generating method according to the first aspect of the present invention comprises a first step of assigning designated tones to respective tone generating channels designated from among a plurality of tone generating channels and writing controlling data for the designated tones into channel registers of the designated tone generating channels for storage therein, a second step of issuing calculation-start instructions at predetermined intervals, a third step of, in response to the calculation-start instructions issued by the second step, arithmetically forming waveform data for plural samples for each of the designated tone generating channels on the basis of the controlling data stored in the channel register of the channel, a fourth step of, for each of the plural samples, mixing the waveform data formed for the designated tone generating channels by the third step so as to form mixed sample data for each of the plural samples, a fifth step of converting the mixed sample data for the plural samples into into an analog signal every sampling cycle, and a sixth step of issuing an to generate a plurality of tones utilizing idle time during processing of the fifth step. The third step performs arithmetic formation of the waveform data only for the channel sounding a tone.

The tone generating method may further comprises a seventh step of setting a predetermined limit period, and an eighth step of determining whether calculations for all designated tone generating channels will be completed within the predetermined limit period. If it is determined that the calculations for all designated tone generating channels will not be completed within the predetermined limit period, the eighth step instructs that a tone should be deadened or muffled in any of the tone generating channels.

Still another implementation of the tone generating method according to the first aspect of the present invention comprises a first step of issuing generation instructions to generate a plurality of designated tones, a second step of assigning the designated tones to respective tone generating channels designated from among a plurality of tone generating channels and writing controlling data for the designated tones into channel registers of the respective designated tone generating channels for storage therein, a third step of determining calculation-processing order across the designated tone generating channels in accordance with respective importance of the tones to be generated in the designated tone generating channels, a fourth step of issuing calculation-start instructions at predetermined intervals, a fifth step of arithmetically forming waveform data for plural samples on the basis of the controlling data stored in the channel registers of the designated tone generating channels in response to the calculation-start instructions issued by the fourth step, a sixth step of, for each of the plural sample, mixing the waveform data formed for the channels, so as to form mixed sample data for the plural samples, and a seventh step of converting the mixed sample data for the plural samples into into an analog signal every sampling cycle. The fifth step performs calculations for forming the waveform data for the designated tone generating channels in accordance with the calculation-processing order determined by the third step, and when it is likely that the calculations for forming the waveform data by the fifth step will not be completed within a predetermined time and the analog signal converted by the seventh step will be broken off, the calculations for forming the waveform data are discontinued at a time point when they are being performed on one of the channels in the calculation-processing order so as to prevent the analog signal from being broken off.

With the above-mentioned present invention according to the first aspect, the preparations in each of the channels need to be made only once for formation of a plurality of waveform samples, thus achieving substantial reduction in overheads. This enhances the quality of generated tones and permits an increase in the number of channels capable of simultaneously generating tones. Further, by controlling the waveform sample calculations or arithmetic formation in such a manner to take place each time a MIDI event is input, the calculations can be performed in a dispersed manner and it is possible to prevent the number of generated tones from being undesirably reduced by the initial tone forming operations. In addition, with the arrangement that the performance information input operation is executed at the time of occurrence of the performance information, and tone control or waveform formation based on the read-in performance information is included in main steps executed in idle times during the input operation, increased processing amounts at the time of performance information occurrence can be dispersed within idle times, so that a temporary increase in the processing amount can be avoided. Of the channels for which the formation is being under way (i.e., sounding channels), such a channel whose tone level (AEG waveform) has sufficiently attenuated is excluded from further calculations to become a non-sounding channel.

Still another implementation of the tone generating method according to the first aspect of the present invention comprises a supply step of supplying a main step of information, a main step of arithmetically forming waveform data, an interrupt step of, when the performance information is supplied by the supply step, temporarily interrupting the main step so as to perform a predetermined input operation for receiving the supplied performance information, and upon completion of the input operation, resuming the main step at a point where the main step is interrupted, and a step of, on the basis of the waveform data formed by the main step, generating a corresponding tone at timing later than a time point when the waveform data is arithmetically formed by the interrupt step. The the main step includes a performance information processing step to create tone controlling data on the basis of the performance information having undergone the input operation, and a tone generator processing step to arithmetically form the form waveform data on the basis of the tone controlling data. Because of the arrangement that when the performance information is supplied by the supply step, the input operation is performed for receiving the supplied performance information and tone control or waveform formation based on the received performance information is included in the main step executed in idle times during the input operation, an increased processing amount at the time of performance information occurrence can be dispersed within the idle times, so that a temporary increase in the processing amount can be avoided effectively.

A tone generating method for execution on a computing unit according to a second aspect of the present invention comprises a system step of executing a predetermined operating system, a waveform formation step of arithmetically forming waveform data for a predetermined number of samples every predetermined period on the basis of an instruction from an application program executed on the predetermined operating system, an output step of outputting, every sampling cycle, one sample of the waveform data arithmetically formed by the waveform formation step, and a control step of, in response to a request by the output step, performing a task switch between the system step and the waveform formation step during the predetermined period.

Another implementation of the tone generating method according to the second aspect of the present invention comprises an input step of inputting performance information, a waveform formation step of, on the basis of the performance information inputted during a predetermined period, arithmetically forming waveform data corresponding to the predetermined period,an output step of outputting, every sampling cycle, one sample of the waveform data corresponding to the predetermined period, a waveform delivery step of supplying the output step with the waveform data corresponding to the predetermined period formed by the waveform formation step, and a request step of detecting when output of the waveform data by the output step has progressed so as to request another supply of the waveform data from the waveform data delivery step. The waveform data delivery step is executed in response to a request by the request step and the waveform formation step is executed after the waveform data delivery step.

Still another implementation of the tone generating method according to the second aspect of the present invention comprises an input step of inputting performance information, a waveform formation step of, on the basis of the performance information inputted during a predetermined period, arithmetically forming waveform data corresponding to the predetermined period, a waveform synthesis step of inputting external waveform data corresponding to the predetermined period and combining the external waveform data and the waveform data arithmetically formed by the waveform formation step so as to form synthesized waveform data for the predetermined period, a waveform processing step of applying signal processing to the synthesized waveform data for the predetermined period, and an output step of outputting, every sampling cycle, one sample of the synthesized waveform data.

Still another implementation of the tone generating method according to the second aspect of the present invention comprises an input step of inputting performance information, a waveform formation step of, on the basis of the performance information inputted by the input step, performing calculations over a plurality of stages so as to arithmetically form waveform data,a step of inputting external waveform data, and a step of inserting the inputted external waveform data in one of the stages of the calculations.

The conventional software tone generators are provided as an application program running on a general-purpose operating system, and software such as a MIDI sequencer and game software is also an application program running on a general-purpose operating system. Under the control of a non-complete (non-preemptive) multitask operating system, no new task is executed unless a running task restores the control to the operating system. Thus, the software tone generator may sometimes be executed at predetermined time intervals, with the result that tone waveform samples can not be outputted stably to a D/A converter every sampling cycle. In contrast, the software tone generator according to the second aspect of the present invention is caused to operate under the control of a multitask management program rather than an application program. This allows the software tone generator to be reliably executed at such time intervals necessary for real-time processing, and also permits a general-purpose operating system to operate so as to execute thereon processing of an application program in periods when the software tone generator is not performing any processing.

Further, in software tone generators such as the one according to the first aspect where waveform data for plural samples are arithmetically formed on a waveform buffer collectively in order to enhance the calculating efficiency, when a waveform reproduction section (DAC) makes a request for waveform formation, it is necessary to deliver the waveform data promptly within a predetermined time. However, if, for example, there occur a number of events at that time, the waveform can not be delivered promptly and stable tone generation becomes difficult. Such a problem can be overcome by the improvement according to the second aspect. In addition, many of the conventional general-purpose computers such as personal computers are provided with an A/D converter, digital waveform input board for inputting sounds, but they can not perform a tone controlling processing function, of a software tone generator, on the thus-input waveform data. This problem can also be overcome by the improvement according to the second aspect.

Still another implementation of the tone generating method according to the second aspect of the present invention comprises a supply step of supplying performance information, a formation step of arithmetically forming waveform data on the basis of control information, an interrupt step of, when the performance information is supplied by the supply step, temporarily interrupting the formation step so as to execute processing of the performance information and, upon completion of the processing of the performance information, resuming the formation step at a point where the formation step is interrupted, and a tone generation step of, on the basis of the waveform data formed by the formation step, generating a corresponding tone at timing later than formation of the waveform data by the formation step.

A tone generating device according to the second aspect of the present invention comprises a memory for storing a tone generator processing program and a performance processing program, a supply section for supplying performance information, a register for storing control information, a calculation section for executing the tone generator processing program and performance processing program. The calculation section normally executes the tone generator processing program to form waveform data on the basis of the control information. When the performance information is supplied by the supply section, the calculation section temporarily interrupts execution of the tone generator processing program so as to execute the performance processing program to thereby create control information corresponding to the supplied performance information and store the created control information in the register, and, upon completion of the performance processing program, it resumes the tone generator processing program at a point where the tone generator processing program is interrupted. The devices also comprises a tone output section for, on the basis of the waveform data formed by the tone generator processing program, generating a corresponding tone at timing later than formation of the waveform data by the calculation section.

Still another implementation of the tone generating method according to the second aspect of the present invention comprises a supply step of supplying performance information, a formation step of arithmetically forming waveform data, an interrupt step of, when the performance information is supplied by the supply step, temporarily interrupting the formation step so as to execute processing of the performance information, and then, upon completion of the processing of the performance information, resuming the formation step at a point where the formation step is interrupted, and a tone generation step of, on the basis of the waveform data formed by the formation step, generating a corresponding tone at timing later than formation of the waveform data by the formation step. The formation step arithmetically forms the waveform data on the basis of the performance information processed by the interrupt step.

Still another implementation of the tone generating method according to the second aspect of the present invention comprises a system step of executing a predetermined operating system, a waveform formation step of arithmetically form waveform data for a predetermined number of samples per predetermined period on the basis of an instruction from an application program executed on the predetermined operating system, an output step of outputting, every sampling cycle, one sample of the waveform data arithmetically formed by the waveform formation step, and a control step of, in response to a request by the output step, performing a task switch between the system step and the waveform formation step during the predetermined period. The waveform formation step performs a tone parameter calculating operation in an intermittent fashion.

Still another implementation of the tone generating method according to the second aspect of the present invention comprises an input step of inputting performance information, a waveform formation step of, on the basis of the performance information inputted during a predetermined period, arithmetically forming waveform data corresponding to the predetermined period, an output step of outputting, every sampling cycle, one sample of the waveform data corresponding to the predetermined period, a waveform data delivery step of supplying the output step with the waveform data corresponding to the predetermined period formed by the waveform formation step, and a request step of detecting when output of the waveform data by the output step has progressed so as to request another supply of the waveform data from the waveform data delivery step. The waveform formation step performs a tone parameter calculating operation in an intermittent fashion, the waveform data delivery step is executed in response to a request by the request step, and the waveform formation step is executed after the delivery step.

Still another implementation of the tone generating method according to the second aspect of the present invention comprises an input step of inputting performance information, a waveform formation step of, on the basis of the performance information inputted during a predetermined period, arithmetically form waveform data corresponding to the predetermined period, a waveform synthesis step of inputting external waveform data corresponding to the predetermined period and combining the external waveform data and the waveform data arithmetically formed by the waveform formation step so as to form synthesized waveform data for the predetermined period, a waveform processing step of applying signal processing to the synthesized waveform data for the predetermined period, and an output step of outputting, every sampling cycle, one sample of the synthesized waveform data. The waveform formation step performs a tone parameter calculating operation in an intermittent fashion.

According to the second aspect as mentioned above, the performance processing is preferentially executed in response to occurrence of performance information and the tone generator processing is executed successively in idle times during the performance processing. With this arrangement, even where the tone generator processing can not be executed to a sufficient degree due to an increased amount of processing responsive to the occurrence of performance information, the deficiency can be made up for at some other time, and hence the tone generator processing can be executed in a stabilized manner. Moreover, because of the arrangement that when the performance information is supplied by the supply step, the input operation is performed for receiving the supplied performance information and tone control or waveform formation based on the received performance information is included in the main step executed in idle times during the input operation, an increased processing amount at the time of performance information occurrence can be dispersed within the idle times, so that a temporary increase in the processing amount can be avoided effectively.

BRIEF DESCRIPTION OF THE DRAWINGS

For better understanding of the above and other features of the present invention, the preferred embodiments of the invention will be described in detail hereinbelow with reference to the accompanying drawings, in which.

DETAILED DESCRIPTION OF THE PREFERRED EMBODIMENTS

Figure 1:
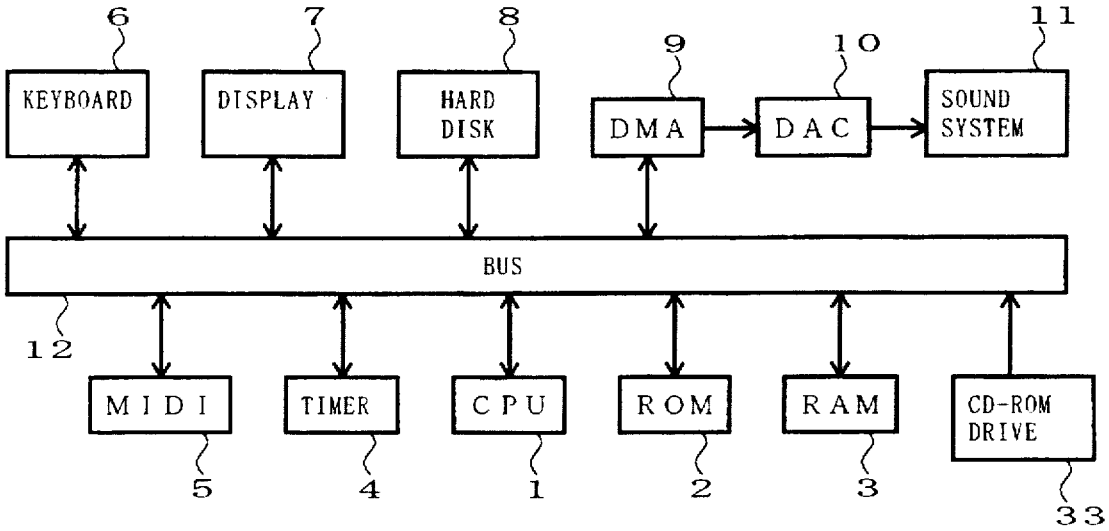
FIG. 1 is a block diagram illustrating a hardware structure of an embodiment of a tone generating device according to a first aspect of the present invention.

First, a description will be made about an embodiment according to a first aspect of the present invention with reference to FIGS. 1 to 12, of which FIG. 1 is a block diagram illustrating a hardware structure of an embodiment of a tone generating device capable of implementing a tone generating method of the present invention.

In FIG. 1, the tone generating device comprises: a microprocessor (CPU) 1 that executes an application program etc. to perform various control in formation of tone waveform samples etc.; a read-on memory (ROM) having stored therein preset tone color data etc.; a random access memory (RAM) including a working memory area for use by the CPU 1, a tone color data area, an input buffer area, a channel register area, an output buffer area etc.; a timer 4 for counting time and instructing timer interrupt timing to the CPU 1; a MIDI interface via which MIDI event data are input and output to and from the device; and a keyboard 6, similar to that of a personal computer, including keys for entering English and Japanese alphabets, numbers and symbols.

The tone generating device further comprises a display (monitor) 7 which enables a dialogue between a user and the device; a hard disk 8 in which is installed an application program such as a program for generating tones and in which are stored tone waveform data to be used for forming tone waveform samples; a reproduction section (DMA: Direct Memory Access) that, with no intervention of the CPU 1, reads out tone waveform data stored in one of the areas of the RAM 3 designated by the CPU 1 and supply the read-out data to a D/A converter (DAC) 10 at a predetermined sampling frequency (e.g., 48 kHz); and a sound system 11 for audibly reproducing or sounding analog tone signals from the D/A converter 10.

The above-mentioned components are similar to those of a personal computer or work station and can be used to implement the tone generating method of the present invention.

Figure 2:
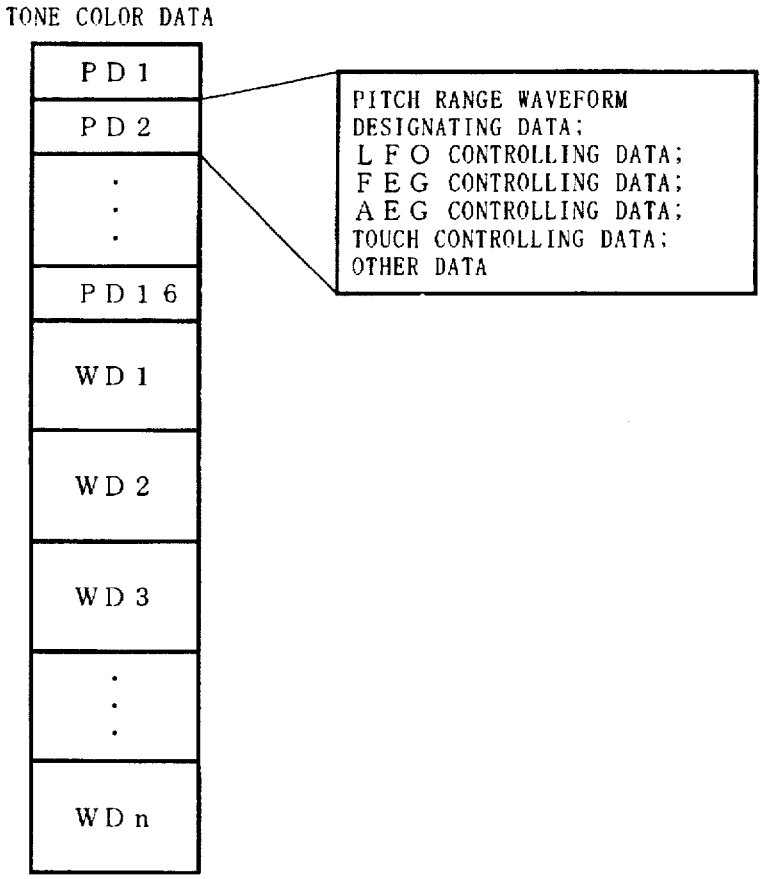
FIG. 2 is a diagram illustrating a tone color data area of a RAM shown in FIG. 1.
Figure 3:
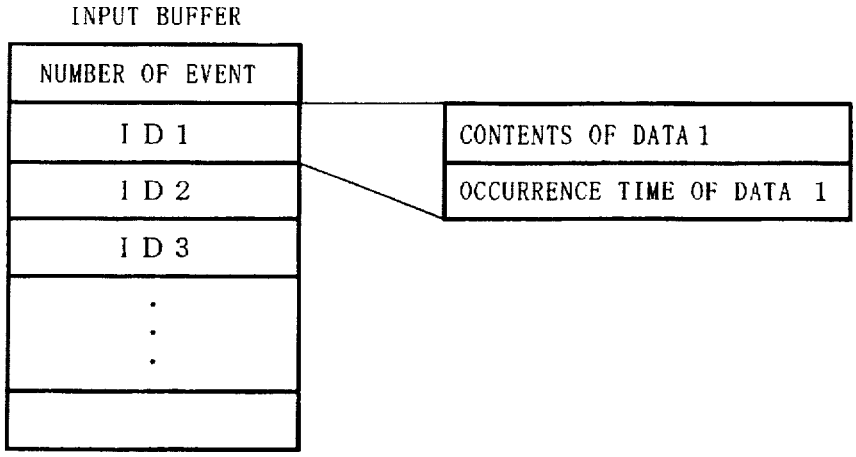
FIG. 3 is a diagram illustrating an input buffer area of the RAM of FIG. 1.
Figure 4:
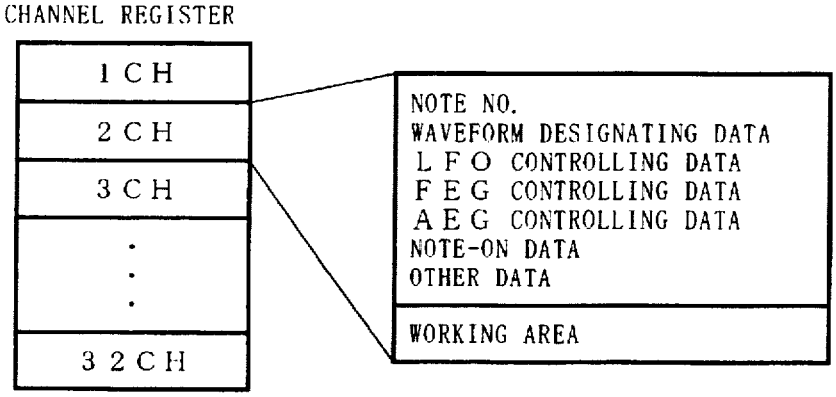
FIG. 4 is a diagram illustrating a channel register area of the RAM of FIG. 1.
Figure 5:
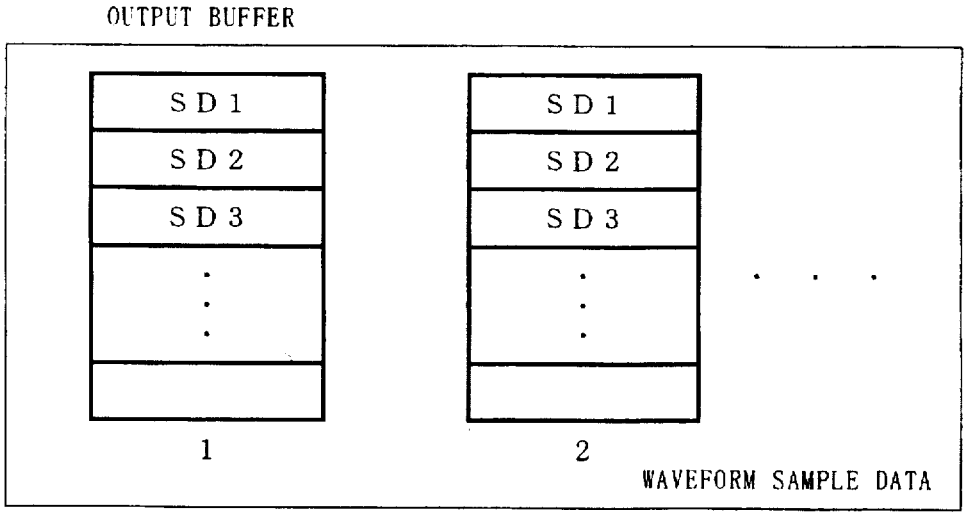
FIG. 5 is a diagram illustrating an output buffer area of the RAM of FIG. 1.

Of the various data storage areas in the RAM 3, the tone color data area is shown in FIG. 2, the input buffer area in FIG. 3, the channel register area in FIG. 4, and the output buffer area in FIG. 5.

In the tone color data area of FIG. 2, "PD1, PD2, . . . , PD16" represent 16 kinds of tone color data, and each of the tone color data is comprised of data designating a waveform of a given pitch range (pitch range waveform designating data), data for controlling LFO (Low Frequency Oscillator) to be used for imparting vibrato effect or the like, data for controlling generation of a filter envelope to provide a controlled tone color filter characteristic, data for controlling generation of an amplitude-controlling envelope, touch controlling data for varying a rising speed of tone or the like in accordance with a detected key-touch velocity, and other data. These data stored in the tone color data area of FIG. 2 are original data, which will be processed, in accordance with touch data, tone pitch data, etc. supplied along with a tone generation instruction, in order to create tone forming data to be used by a tone generator.

Further, "WD1, WD2, . . . , WDn" in FIG. 2 represent waveform data, any of which is designated by the pitch range waveform designating data of one of the tone color data PD1, PD2, . . . , PD16 in accordance with input tone pitch data.

MIDI event data ID1, ID2, ID3, . . . , indicative of various events such as note-on and note-off events and received via the MIDI interface 5 are sequentially written into the input buffer shown in FIG. 3. By reading out these MIDI event data ID1, ID2, ID3, . . . , an event process is performed in the tone generating device. Each of the MIDI event data ID1, ID2, ID3, . . . is comprised of data indicative of the contents of the MIDI event and time at which the event data occurred (data occurrence time or event occurrence time). The data occurrence time can be determined by reading current time counted by the timer 4 when the MIDI event data is received.

The area shown in FIG. 4 is used as a channel (CH) register for storing data to control formation of individual tones, and in the illustrated example, the channel register area provides storage locations for a total of 32 channels.

Each of the channel storage locations stores a note number, waveform designating data, LFO controlling data, filter envelope designating data (FEG controlling data), amplitude envelope controlling data (AEG controlling data), note-on data and other data, as well as a working area to be used by the CPU 1 during execution of a program. The waveform designating data, LFO controlling data, FEG controlling data and AEG controlling data in the channel register area of FIG. 4 are tone forming data obtained by processing the respective original data of FIG. 2.

The area shown in FIG. 5 is for a plurality of output buffers which are used in turn as tone waveform forming output buffers X. Each time tone waveform sample data for individual tone generating channels SD1, SD2, SD3, . . . are formed by arithmetic operations as will be later described, these data are accumulated channel by channel and the resultant accumulated data are stored into the output buffers. Two or more of these output buffers are designated as the tone waveform forming output buffers X and used in waveform calculating operations. In the simplest form, two output buffers X may be used to provide a double-buffer structure such that while the data stored in one of the buffers X is being reproduced by the reproduction section (DMA) 9, new waveform sample data obtained through the waveform forming operations is stored into the other buffer X.

The output buffers may be set to have any optional size, such as 100, 500, 1K or 5K word size. If the output buffers are set to a large size, there will occur an appreciable time delay in formation of tones; if the output buffers are set to a small size, the time margin will be reduced substantially, which results in a poor response when there is a temporary increase in the amount of arithmetic operations to be made. Thus, for a sequencer performance or the like where no real-time processing capability is required, the output buffer size may be made large because the time delay in the tone formation can be compensated by advancing the performance timing. On the other hand, for a keyboard performance or the like where a real-time processing capability is required, it is preferred that the output buffer size be set 100 to 200 words so as to prevent a time delay in the tone formation. The above-proposed data sizes are preferable in cases where the sampling frequency is 40 to 50 kHz. For a lower sampling frequency, however, the output buffer size has to be smaller in order to avoid a time delay in the tone formation.

Next, a description will be made hereinbelow about first to fifth embodiments of the tone generating method of the present invention, each of which embodiments can be implemented by use of the tone generating device shown in FIG. 1.

The tone generating method in accordance with the first embodiment is characterized in that plural (e.g., 100) tone waveform samples are formed collectively in a tone forming process for each channel by means of the CPU 1 executing a tone forming application program. Specifically, in the tone forming process, tone waveform samples are formed collectively, for each of the tone generating channels, in response to 100 sampling cycles of the D/A converter 10.

Thus, at every predetermined calculating point, the tone forming process is performed for all the channels. Where the number of the formed tone waveform samples is "100", these samples are sequentially accumulated as a channel-specific accumulated value for 100 sampling cycles of the D/A converter 1 and stored into the above-mentioned output buffer. Once the sample accumulation is completed for all the tone generating channels, the tone waveform samples stored in the output buffer are read out, one sample at each sampling cycle, by the reproduction section (DMA) 9 and supplied through the D/A converter 10 to the sound system 11 for audible reproduction. The predetermined calculating point in this embodiment is controlled to occur at intervals such that when the tone forming process is performed by using the output buffers in turn, all the tone waveform samples can be read out and reproduced completely without being dropped halfway.

According to the first embodiment of the tone generating method, preparatory operations need to be performed, for each of the channels, only once for the plural tone waveform samples to be formed collectively, and hence it is allowed to reduce the proportion of an arithmetic operating or calculating time to be spent on the preparatory operations to the entire calculating time, so that overheads are reduced substantially. This can substantially enhance the quality of the formed tone waveform samples and increase the number of simultaneously general table tones.

Each time section between the predetermined calculating points may be divided into "n" equal parts so that the waveform sample forming calculations are performed at intervals corresponding to the "n" parts, and the reproduction section (DMA) 9 may read out each group of the tone waveform samples completely calculated in the "n"th part.

Next, the tone generating method in accordance with the second embodiment will be described, in which plural tone waveform samples are formed collectively in the tone generation process, for each channel, by the CPU 1 executing the tone forming application program in a similar manner to the first embodiment, and in addition, each time input data (in this case, MIDI event data) is received through the MIDI interface 5, waveform arithmetic operations or calculations are performed for samples up to the time point. At the predetermined calculating point, tone waveform sample calculations are performed only on uncalculated ones of a predetermined plurality of tone waveform samples (i.e., samples corresponding to the size of each of the output buffers).

In the tone forming process, where the waveform sample calculations are performed for each of the tone generating channels currently sounding tones, more arithmetic operations are required in each of the channels where there is present a key-on or key-off event involving a particular form of tone generation varying in response to input data (pitch bend or tone volume change), than in other channels where tone generation is continued with no variation responsive to the input data. In such a case, with the calculating points set to occur at fixed intervals, much of the operating period will be occupied by the channels involving a change in the form of tone generation, which eventually reduces the number of tone generating channels for which the necessary arithmetic operations can be completed within the limited time. In particular, for each of the channels where tone generation is to start, many initializing operations such as initialization of an address counter and envelope generator and generation of an "F" number are necessary, thus taking a long operating time.

Figure 12:
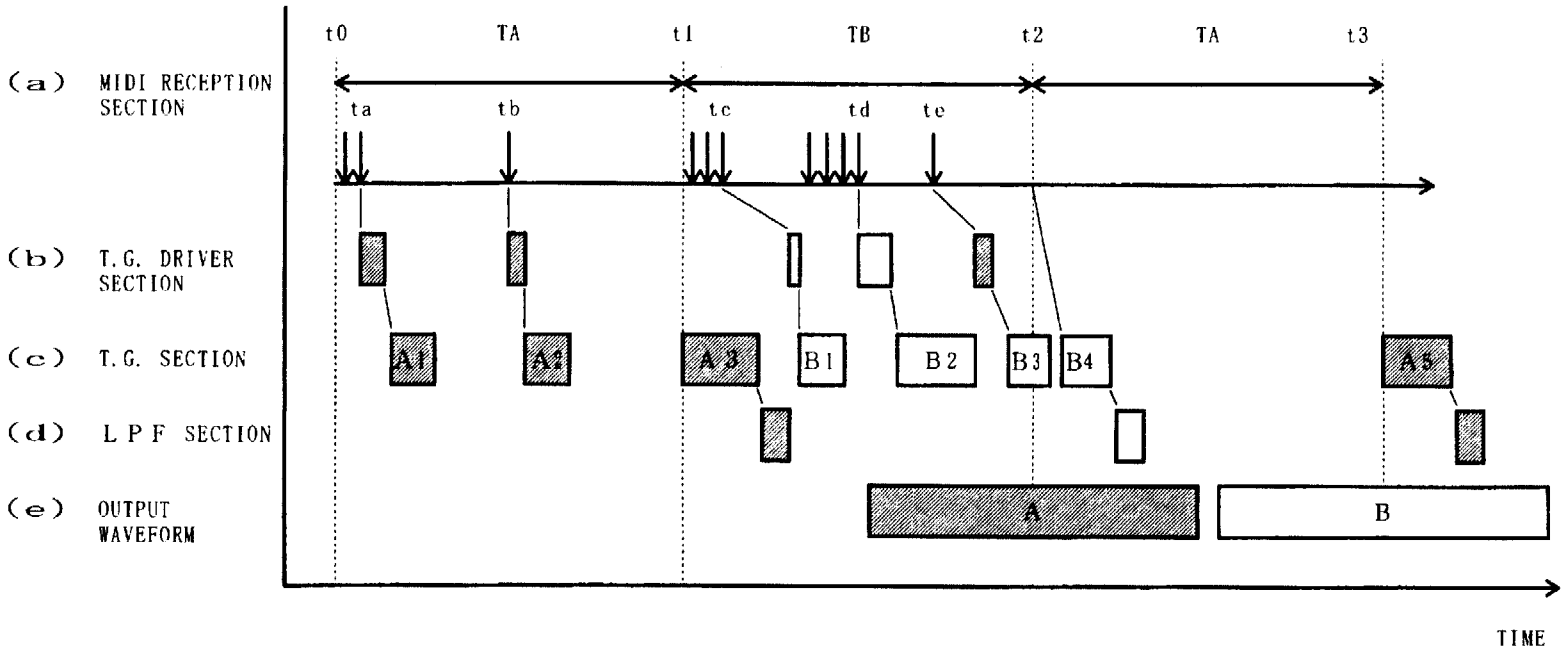
FIG. 12 is a timing chart explanatory of a second embodiment of the present invention.

FIG. 12 is a timing chart explanatory of the second embodiment, where first and second output buffers A and B are provided as the above-mentioned double-buffer structure and shown in the figure in part (e). Times required for reproduction from the buffers A and B are shown by TA and TB, respectively, and time TA is equivalent to TB in this embodiment.

First, once two MIDI events are received by a MIDI reception section at point Ta in a calculating time range from point T0 to point T1 that is allocated for the first output buffer A as shown in part (a) of FIG. 12, a tone generator (T. G.) driver section performs processing as shown in part (b), and a tone generator (T. G.) section calculates tone waveform samples A1 corresponding to the input received during a period from point t0 to point ta.

The MIDI reception section includes the MIDI interface 5 through which each input MIDI event is received, and the MIDI reception section writes, into the input buffer, the MIDI event along with its occurrence time. The tone generator driver section receives data from the input buffer or from the personal computer keyboard 6, assigns the received data to one of a plurality of tone generator channels and executes a conversion from voicing parameters to tone generator parameters in accordance with the input data. Further, the tone generator section receives the tone generator parameters and processes waveform data to form tone waveform samples that are to be actually sounded. An LPF section removes aliasing noise components from the formed tone waveform sample, and output data from the LPF section is written into the first and second output buffers A and B. The above-mentioned tone generator driver, tone generator and LPF sections are functions performed by the CPU 1 executing the application program.

Then, once one MIDI event is received by the MIDI reception section at point Tb, the tone generator driver section performs processing as shown in part (b) similarly to the above-mentioned, and the tone generator section calculates tone waveform samples A2 corresponding to the input received during a period from point ta to point tb. Then, upon arrival at point t1, the tone generator section calculates tone waveform samples A3 corresponding to the input received during a period from point tb to point t1. In this case, when key-on events are received at points ta and tb, tone generating initialization and arithmetic operations are performed at this point T1. After that, the LPF performs a filtering operation, and thus necessary tone waveform sample formation is completed for the first output buffer A.

Then, three MIDI events are received by the MIDI reception section at point tc in a calculating period from point t1 to point t2 that is allocated for the second output buffer B as shown in part (a) of FIG. 12. Because the tone generator section is currently calculating tone waveform samples A3, the input event data are temporarily held in the input buffer until a calculating time is allocated to the data. Upon completion of the calculations of tone waveform samples A3 by the tone generator section and the filtering operation by the LPF section, the event data are read out from the input buffer to be processed by the tone generator driver section, and thus the tone generator section calculates tone waveform samples B1 corresponding to the input received during a period from point t1 to point tc. Even if some time delay occurs in the calculating operations, it does not influence the tone generation timing because the occurrence times of the input event data have also been written in the input buffer.

After that, four MIDI events are received by the MIDI reception section during the calculations of the tone waveform samples B1, and these event data are processed to calculate corresponding tone waveform samples after the calculations of the tone waveform samples B1, similarly to the above-mentioned.

In the same manner, tone waveform samples B2 are formed as samples corresponding to the input received during during a period from point tc to point td, tone waveform samples B3 are formed as samples corresponding to the input received during a period from point td to point te, and tone waveform samples B4 are formed as samples corresponding to the input received during a period from point te to point t2. Then, tone waveform samples A5 are formed as samples corresponding to the input received during a period from point t2 to point t3.

As seen from the foregoing, every time input data occurs, the second embodiment calculates waveform samples for a period preceding the input data occurrence, and thus the waveform sample calculations can be performed in a substantially dispersed fashion. Thus, the amount of operations performed in each calculating period at predetermined intervals is limited appropriately, so that even when there occur many input data such as key-on event data involving a variation in the form of tone generation, it is possible to avoid inconveniences such as reduction in the number of simultaneously generatable tones.

Next, the tone generating method in accordance with the third embodiment will be described.

In order to generate tones successively in the case where the calculating points are generated at predetermined intervals and a predetermined number of tone waveform samples are formed collectively in each calculating period through arithmetic operations, the predetermined number of tone waveform samples must be supplied before formation of the preceding tone waveform samples is completed. But, if the number of tone generating channels is relatively great and hence the amount of waveform calculating operations is excessive, there will arise a problem that tone waveform samples of all the channels can not be supplied in time, causing an undesirable interruption or break of generated tones.

The tone generating method in accordance with the third embodiment is contemplated to provide a solution of such an inconvenience. More specifically, the third embodiment determines whether the predetermined number of tone waveform samples can be supplied in time for the data conversion timing of the D/A converter 10. If it is determined that the tone waveform samples can be supplied in time for the data conversion timing, one or more of the tone generating channels are selected whose tone has a relatively low importance in all the tones being generated at the present time. Then, for the designated channel, the embodiment calculates, in a short time, damping waveform samples which correspond to the initial period of the waveform.

Because only the short-period damping waveform samples are calculated for the designated tone generating channel, the necessary calculating time for this channel can be reduced so that the predetermined number of tone waveform samples as a whole is supplied in time for the data conversion timing of the D/A converter 10.

Generally, tones that are determined as "important" in the third embodiment are:

(1) tone currently having a great volume;

(2) tone whose attack portion has just started to be sounded;

(3) lowest-pitch tone (bass) when tones of two or more parts are being sounded;

(4) highest-pitch tone when tones of two or more parts are being sounded; and (5) tone of a solo part when tones of two or more parts are being sounded.

The third embodiment may be modified as follows. The tone generating channels are placed in descending order of importance of tones to be generated therein before the waveform sample calculations, in such a manner that the sample calculations are effected sequentially from the most important tone to the least important tone. If the waveform sample calculations for all the channels can not be completed in time, the calculations are broken off so that tones are generated only with tone waveform samples having so far been formed. Thus, in case there is a need to interrupt the sample calculations, only a tone or tones will be deadened or muffled which have a relatively low importance and hence have a relatively small influence.

In the above-described third embodiment and modification thereof, the waveform sample calculations may be performed each time input data occurs. Alternatively, the waveform sample calculations may be performed collectively for each time section, rather than in response to occurrence of each input data; in this case, a trigger signal may preferably be generated to advance the calculating point in accordance with the number of input data. In another modification, each time section between the predetermined calculating points may be divided into "n" equal parts so that the waveform sample calculations are performed at intervals corresponding to the "n" parts, and the reproduction section (DMA) 9 may read out each group of the tone waveform samples completely formed in the "n"th part.

In order to generate tones successively in the case where the calculating points are generated at predetermined intervals and a predetermined number of tone waveform samples are formed collectively through arithmetic operations, the predetermined number of tone waveform samples must be supplied before formation of the preceding tone waveform samples is completed. But, if the number of tone generating channels is relatively great and hence the amount of waveform calculating operations is excessive, or if the predetermined number of tone waveform samples can not be supplied in time e.g. because too much time is spent on other processing than the tone forming process (such as sequencer processing), one or more tone waveform samples will be read out in the course of still being processed, resulting in unwanted noise.

The tone generating method in accordance with the fourth embodiment is contemplated to provide a solution of such an inconvenience. In the fourth embodiment, the CPU 1 instructs the reproduction section (DMA) 9 to send the data stored in either of the output registers, and addresses of the output buffer itself for storing the predetermined number of the formed tone waveform samples can be set in the reproduction section 9 as one of readout sections or as a repetitive readout section from which data are to be read out repeatedly. In addition, a readout section reservation may be made in such a manner that data at the addresses can be read out immediately following a particular readout section from which data are being currently read out.

According to the fourth embodiment, the readout section reservation allows the formed tone waveform samples to be registered in the output buffer for the reservation purpose and to be read out immediately following a specific waveform being currently read out. In the event that the calculations for the predetermined number of tone waveform samples have not been completed in time, such a reserving registration is not effected, and therefore it is possible to prevent occurrence of noise which would otherwise be caused by sounding of any of the tone waveform samples that is still in the course of being processed. This will temporarily interrupt sounding of a tone, but adverse effects resulting from the interruption will be significantly reduced by limiting the interruption time to only several sampling periods in the case where the sampling frequency is for example 44.1 kHz. The limitation of the interruption time may be effected by limiting the number of channels generating tones, as mentioned earlier. Once the calculations have been completed, the reserving registration is carried out, so that the corresponding waveform samples are sounded.

The waveform sample calculations may be performed collectively for each time section, rather than in response to occurrence of each input data. In such a case, a trigger signal may preferably be generated to advance the calculating point in accordance with the number of input data. In another modification, each time section between the predetermined calculating points may be divided into "n" equal parts so that the waveform sample calculations are performed at intervals corresponding to the "n" parts, and a reserving registration may be made for sounding of tone waveform samples for one time section that have been completely formed in the last "n"th calculation.

As mentioned earlier, in order to generate tones successively in the case where the calculating points are generated at predetermined intervals and a predetermined number of tone waveform samples are formed collectively through arithmetic operations, or where the waveform sample calculations are executed in response to occurrence of each input data, the predetermined number of tone waveform samples must be supplied before formation of the preceding tone waveform sample is completed.

As the calculating point for a specific tone waveform sample, such a point is designated, on the basis of a time point when formation of preceding tone waveform samples is ended (end time point of the preceding tone waveform sample), which is earlier than a prescribed end time point by the time necessary for completing formation of a waveform. Because the end time point is identified by the CPU 1 checking the current state (flag) of the reproduction section (DMA) 9 to thereby detect when the sample reproducing time section has moved onto a next one, the actual end time point will be delayed until the CPU 1 detects the change in the state (flag) of the reproduction section (DMA) 9. Further, because this time delay depends on the timing when the CPU 1 effects the above-mentioned detection, the individual formed samples will present non-uniform delays depending on the respective detection timing.

When the calculating points are generated on the basis of such non-uniformly delayed end time point, correct calculating points can not be obtained. In particular, if the calculating points are generated on the basis of greatly delayed timing, a total time length between the calculation start and the supply of waveform data is substantially shortened, so that the number of simultaneously generated tones is temporarily reduced.

The tone generating method in accordance with the fifth embodiment is contemplated to provide a solution of such an inconvenience.

According to the fifth embodiment, the CPU 1 stores in memory a plurality of time points when a change in the state of the reproduction section (DMA) 9 was detected in the past, and by averaging the stored time points, the CPU 1 predicts a time point when such a change will be detected next. Since the predicted time point corresponds to an average of time delays from the prescribed end time point in the reproduction section (DMA) 9, a point that is a predetermined time before the predicted time point can be detected as a practically correct end time point. Thus, the calculating point is generated on the basis of the correct end time point. In this way, the detected end time points are averaged to reduce non-uniformity thereof, and thus the operating period allocated for each calculating point is effectively uniformized in such a manner that tone forming operations are performed in a stabilized manner.

The waveform sample calculations may be performed collectively for each time section, rather than in response to occurrence of each input data. In such a case, a trigger signal may preferably be generated to advance the calculating point in accordance with the number of input data. In another modification, each time section between the predetermined calculating points may be divided into "n" equal parts so that the waveform forming calculation process is performed at intervals corresponding to the "n" parts, and a reserving registration may be made for sounding of tone waveform samples for one time section that have been completely formed in the last "n"th calculation.

The essential operation of the tone generating device and method as set forth above in connection with the first to fifth embodiments will be described hereinbelow with reference to flowcharts.

Figure 6:
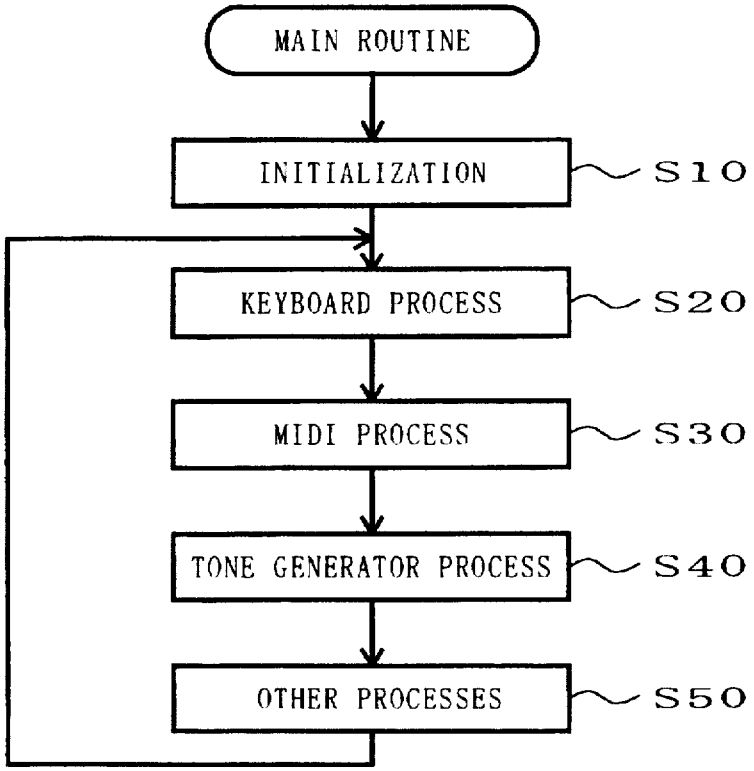
FIG. 6 is a flowchart of a main routine carried out by a CPU of FIG. 1.

FIG. 6 is a flowchart of a main routine carried out by the CPU 1. Upon start of the main routine, an initialization process is executed at step S10, where the timer 4 and DMA 9 are set to respective initial states, all the tone generating channels are cleared, and tone color data and waveform data, etc. are prepared. Then, the CPU 1 moves to step S20 where a keyboard process is executed to process input data from the keyboard 6. At next step S30, a MIDI process is executed for operations corresponding to an input MIDI event. Further, a tone generator process is executed at step S40 for performing the waveform sample calculations to form tone waveform samples etc., and other necessary processes are executed at step S50. After step S50, the routine loops back to step S20 to repetitively perform the processes of steps S20 to S50 as mentioned above in a constant loop. These processes may be performed simultaneously with execution of another software program by use of a multitask technique.

Figure 7:
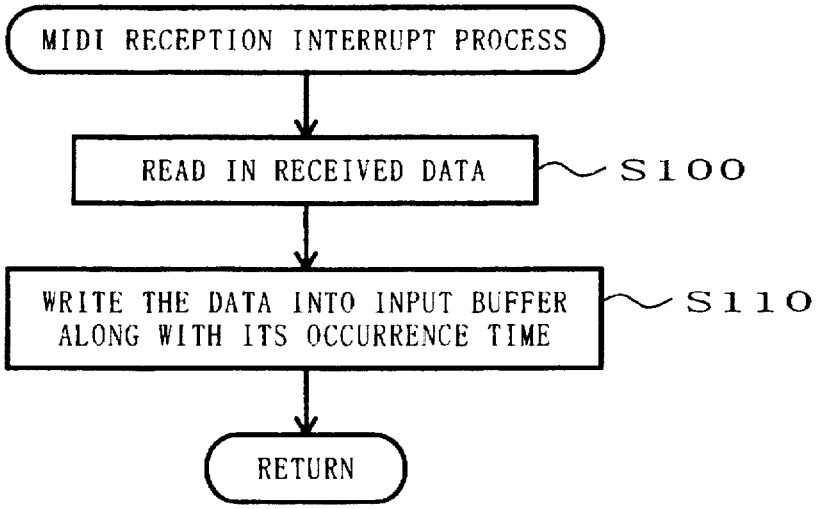
FIG. 7 is a flowchart of a MIDI reception interrupt process in tone generating processing according to the present invention.

FIG. 7 is a flowchart of a MIDI reception interrupt process carried out by the CPU 1, which is started by an interrupt signal when MIDI event data is received via the MIDI interface 5 from the outside. This MIDI reception interrupt process is executed with priority over any other processes. Upon start of the MIDI reception interrupt process, the MIDI event data received through the interface 5 is read into the tone generating device at step S100 and written at step S110 into the above-described input buffer along with the occurrence or reception time of the data, and then the CPU 1 returns to one of the processes in the main routine that was being executed when the interrupt signal was given. In this manner, each received MIDI event data is written into the input buffer along with the reception time.

Figure 8:
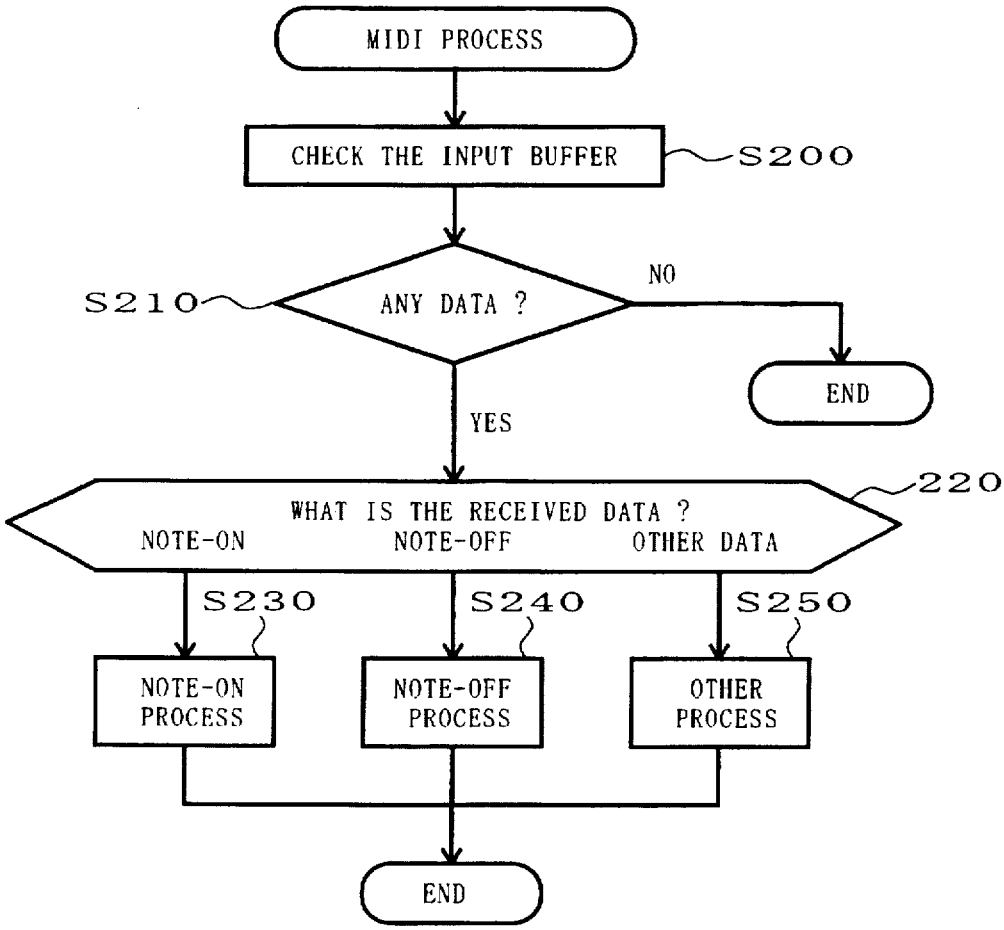
FIG. 8 is a flowchart illustrating a detail of a MIDI process executed by the CPU in the main routine of FIG. 6.

FIG. 8 is a flowchart illustrating a detail of the MIDI process executed at step S30 in the main routine. First, the CPU 1 checks the input buffer at step S200, and at step S210, it ascertains whether the input buffer contains any received data still unprocessed or uncalculated. If there is any uncalculated received data in the input buffer as determined at step S210, then an operation corresponding to the contents of the uncalculated received data is performed at step S220. That is, if the received data is note-on event data, the CPU 1 goes to step S230 to execute a note-on process; if the received data is note-off event data, the CPU 1 goes to step S240 to execute a note-off process; and if the received data is other data, the CPU 1 goes to step S250 to perform other process. Upon completion of one of the processes at step S220, the MIDI process ends. In the event that there is no uncalculated received data in the input buffer as determined at step S210, the MIDI process ends immediately without the following operations being executed.

Figure 9A:
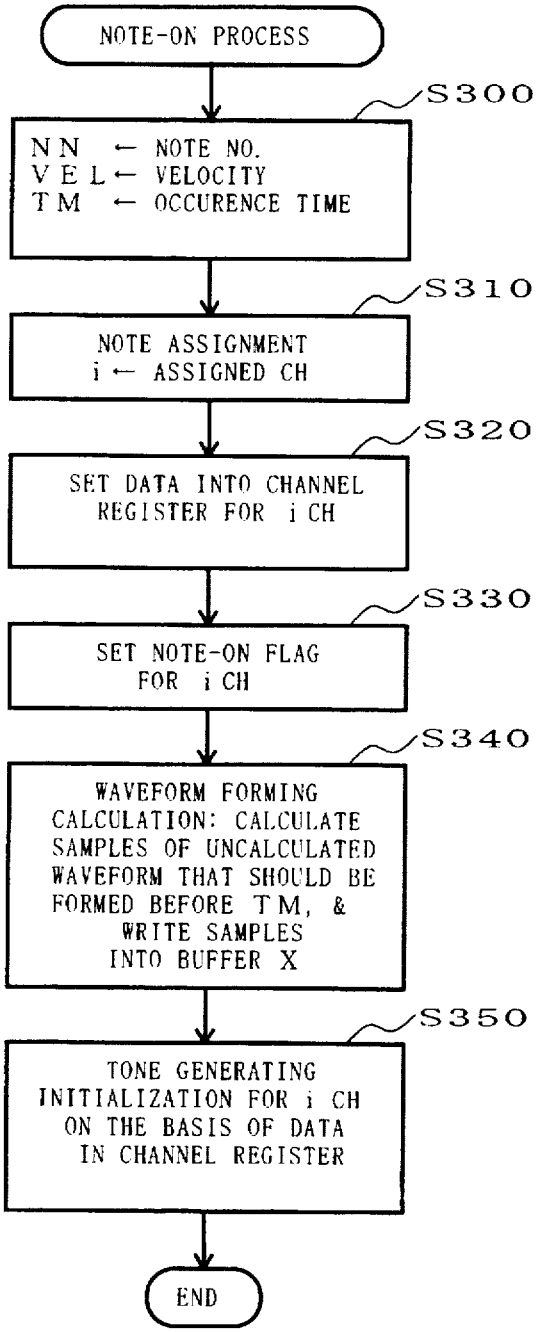
FIG. 9A is a flowchart of a note-on process executed by the CPU in the MIDI process of FIG. 8 when received data is note-on event data.

FIG. 9A is a flowchart of the note-on process executed at step S230 in the MIDI process when the received data is note-on event data. First, as step S300, the note number, velocity and occurrence time of the note-on event in the input buffer are loaded into note number, velocity and occurrence time registers as "NN", "VEL" and "TM". Then, at step S310, the note number "NN" is assigned to one of the channels and the channel number of the assigned channel is loaded into a channel number register as "i".

Further, at step S320, tone control data corresponding to the note number "NN" and velocity "VEL" are set in one of the channel registers CH of FIG. 4 allocated for the channel number "i". The thus-set tone control data are tone forming data (other data of FIG. 4) derived by processing tone color data of FIG. 2, corresponding to the MIDI channel having received the note-on event data, in accordance with the values of the note number "NN" and velocity "VEL". Here, waveform designating data in the tone forming data is obtained by reading out the pitch range waveform designating data, of the tone color data of FIG. 2, corresponding to the note number "NN", and the read-out designating data specifies any one of waveform data WD1 to WDn. After the setting of the tone control data, a note-on flag for channel "i" is set or put up at step S330.

Thereafter, the CPU 1 proceeds to step S340 to perform the waveform forming calculation process. In this case, the waveform forming calculation process is performed to calculate samples for an uncalculated part of the waveform to be written in the now-writable output buffer X, and the thus-calculated partial waveform is written into the output buffer X. The partial waveform corresponds to such a range of the waveform that becomes capable of being calculated or formed at a time point when the new received data is detected at step S210 (i.e., when reception of the data is confirmed). The partial waveform to be formed here is uncalculated waveform samples for a time period before the occurrence time TM of the received note-on event, and a waveform that should start being sounded in response to the note-on event is not included in the current waveform but included in a waveform to be formed later, as will be detailed later in relation to FIG. 11.

The operations at steps S340 and S350 correspond to the waveform calculations of waveform samples A1, A2 or the like described earlier in relation to FIG. 12. At step S350, the working area of the channel register for the channel number "i" is initialized for tone generation on the basis of the tone control data having been set for the channel number "i" at the above-mentioned step S320. This working area stores therein current values of address and various envelopes, current status, current values of an LFO waveform and other data necessary for forming a waveform of each of the channels. The note-on process ends after completion of this tone generating initialization process. In the initialization process, various initializing operations are performed such as initial setting of a start address to the current waveform read address, generation of an "F" number corresponding to the note number NN, initial setting of the LFO, filter EG, tone volume EG, interpolating operation and filter operation. This initialization process takes a considerable calculating time as mentioned earlier.

Figure 9B:
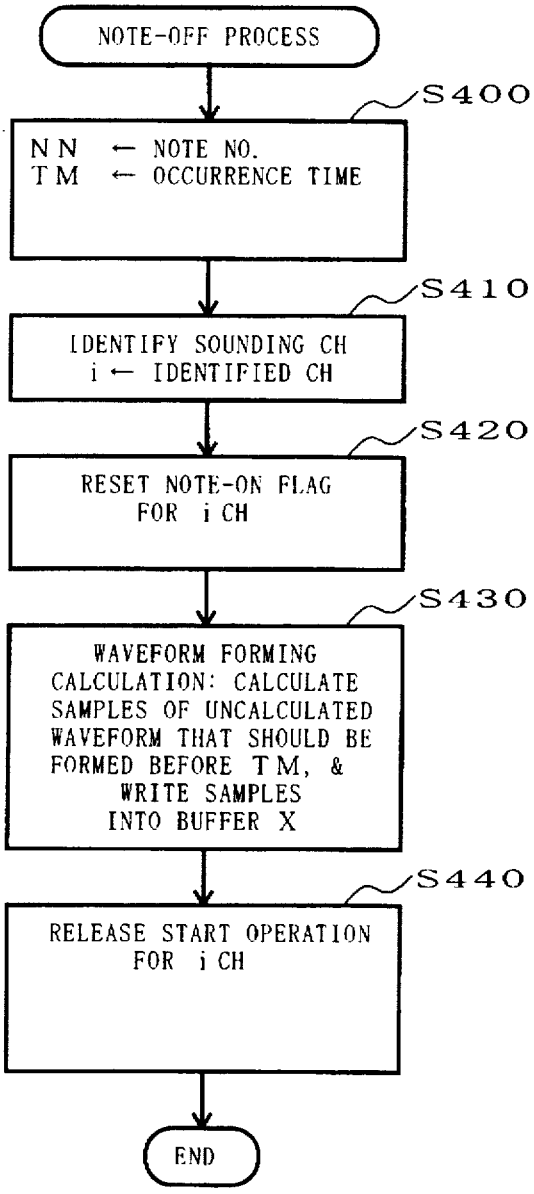
FIG. 9B is a flowchart of a note-off process executed by the CPU in the MIDI process of FIG. 8 when received data is note-off event data.

FIG. 9B is a flowchart of the note-off process executed at step S240 in the MIDI process when the received data is note-off event data. First, as step S400, the note number and occurrence time of the note-off event stored in the input buffer are loaded into the note number and occurrence time registers as "NN" and "TM". Then, at step S410, one of the tone generating channels CH currently sounding note number NN is identified and the channel number of the identified channel is loaded into the channel number register as "i".

After that, the note-on flag for the "i" channel is put down or reset at step S420, and the waveform forming calculation process is performed at step S430, in a similar manner to the above-mentioned step S340, in order to calculate uncalculated waveform samples (partial waveform) that should be formed before the occurrence time TM and write the thus calculated waveform samples into the output buffer X. The note-off process ends after a release start operation for the "i" channel at step S440. In the release start operation, respective states of various envelopes for the "i" channel contained in the working area are rewritten so as to change the tone forming state in the channel into the release state.

Figure 10:
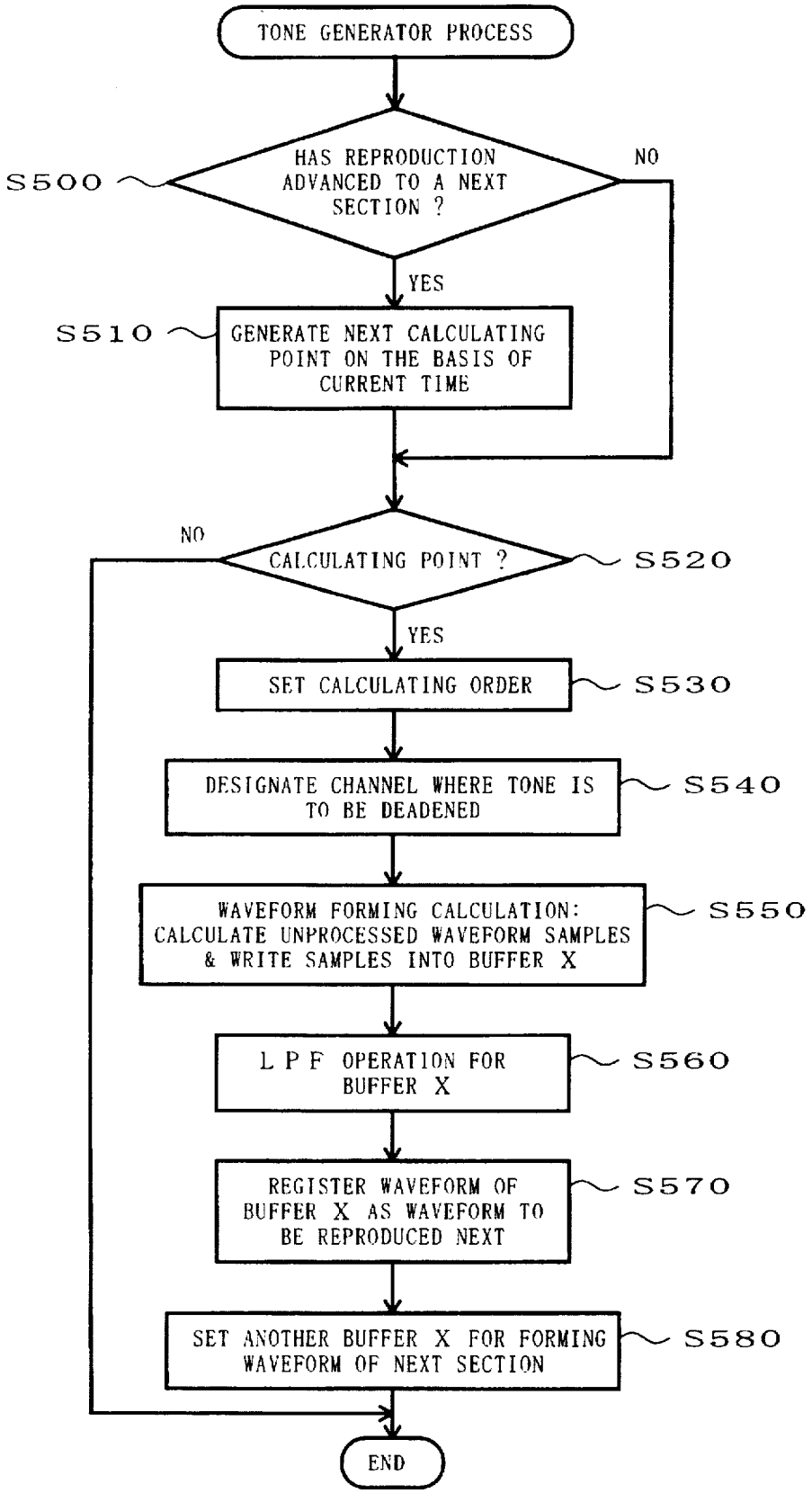
FIG. 10 is a flowchart of a tone generator process executed by the CPU in the main routine of FIG. 8.

Next, with reference to FIG. 10, a description will be made about a detailed flowchart of the tone generator process executed at step S40 in the main routine. First, at step S500, the reproducing state of the reproduction section (DMA) 9 is checked at step S500. If the DMA 9 has advanced to a next to-be-reproduced section, the CPU 1 goes to next step S510, but if not, the CPU 1 jumps to step S520. The DMA 9 reads out waveform samples one by one, at a predetermined sampling frequency, from a specific one of the areas of the RAM 3 which is designated by the CPU 1 and supplies the readout samples to the DAC 10 for audible reproduction. While thus reading the waveform samples from the designated area, the DMA 9 accepts a reservation from the CPU 1 designating another area to be reproduced. Once reproduction of the preceding area has been completed, waveform samples of the next area thus reserved are similarly read out one by one by the DMA 9 and supplied to the DAC 10 for audible reproduction. The advancement of the DMA 9 to a next to-be-reproduced section means herein that after completion of the reproduction of a specific area designated last as the to-be-reproduced section, the DMA 9 has moved to another specific area reserved as a next to-be-reproduced section. In this case, the specific areas of the RAM 3 are reproduced in the order in which they w ere reserved.

Then, at step S510, time when such an advancement will be detected next (next advancement detection time) is predicted on the basis of the time of the current and previous advancement detections, and a time point that is a predetermined time before the predicted detection time is designated as a next calculating point. The next advancement detection time may be predicted such as by calculating an approximate value with a small error through the "least squares method" on the basis of a plurality of the advancement detection times including the current and last ones, or by using a quadratic function or the like to approximate a variation in the detection times. Non-uniform time delays occur in the DMA 9, during a period between the occurrence and detection of the advancement, due to differences in the respective operating step positions and states, so that the advancement detection times contain irregular non-uniformity. Therefore, the calculations of the approximating function involve an operation to average the non-uniform detection times.

The above-mentioned "predetermined time" before the predicted detection time is a time allocated for forming a tone waveform and depends on the amount of necessary arithmetic operations for the waveform formation as determined by a desired number of tones to be generated, desired quality of the arithmetic operations, etc. The length of the "predetermined time" may be fixed, or may be variably set via a user's selection on the keyboard 6 or automatically set by the CPU 1 in consideration of two or more simultaneously running programs.

Then, at step S520, a comparison is made between the next calculating point and the current time indicated by the timer 4, in order to determine whether the current time has arrived at the next calculating point. If the determination is in the affirmative, the CPU 1 performs operations of steps S530 to S580. First, at step S530, specific calculating order is decided in which the currently sounding channels should undergo the waveform sample calculations later at step S550 to form waveform data for a plurality of samples for each of the currently sounding channels.

That is, at step S530, the calculating order is set in such a manner that the waveform sample calculations are performed sequentially from a musically significant tone or tone which would present a significant musical inconvenience if deadened or muffled at that moment. Then, at step S540, it is ascertained whether the waveform sample calculations for all the currently sounding channels can be completed within a predetermined calculating time (i.e., the predetermined time described in relation to step S510). If answered in the negative, one or more tone generating channels where the waveform sample calculations are to be performed last or later than any other channels are designated as channels where tone is to be deadened (tone deadening channels), so that the amount of arithmetic operations is reduced in such a manner that the waveform sample calculations for all the currently sounding channels can be completed within the predetermined calculating time. This process is detailed processing in the above-mentioned third embodiment of the tone generating method.

At step S550, the waveform sample calculations are actually performed. Specifically, uncalculated waveform samples are calculated and written into the currently available output buffer X so that the buffer X is filled with the calculated waveform data and thus gets ready for tone generation. This operation corresponds to the formation of waveform A3 or the like as described earlier in relation to FIG. 12.

Each sample written in the filled-up output buffer X is then subjected to a low-pass filtering operation at step S560 so as to remove high frequency components therefrom. Following this, the output buffer X storing the low-pass filtered waveform is reserved at step S570 as a specific storage area for a waveform to be reproduced next, so that this storage area is reproduced after completion of reproduction of waveforms in the currently reproduced and already reserved storage areas. Then, at step S580, another output buffer than the one so far used as the buffer X is cleared and newly set as the output buffer X for preparing a waveform for the next to-be-reproduced section.

If the current time has not yet arrived at the calculating point as determined at step S520, the tone generator process ends without the other operations being performed.

Figure 11:
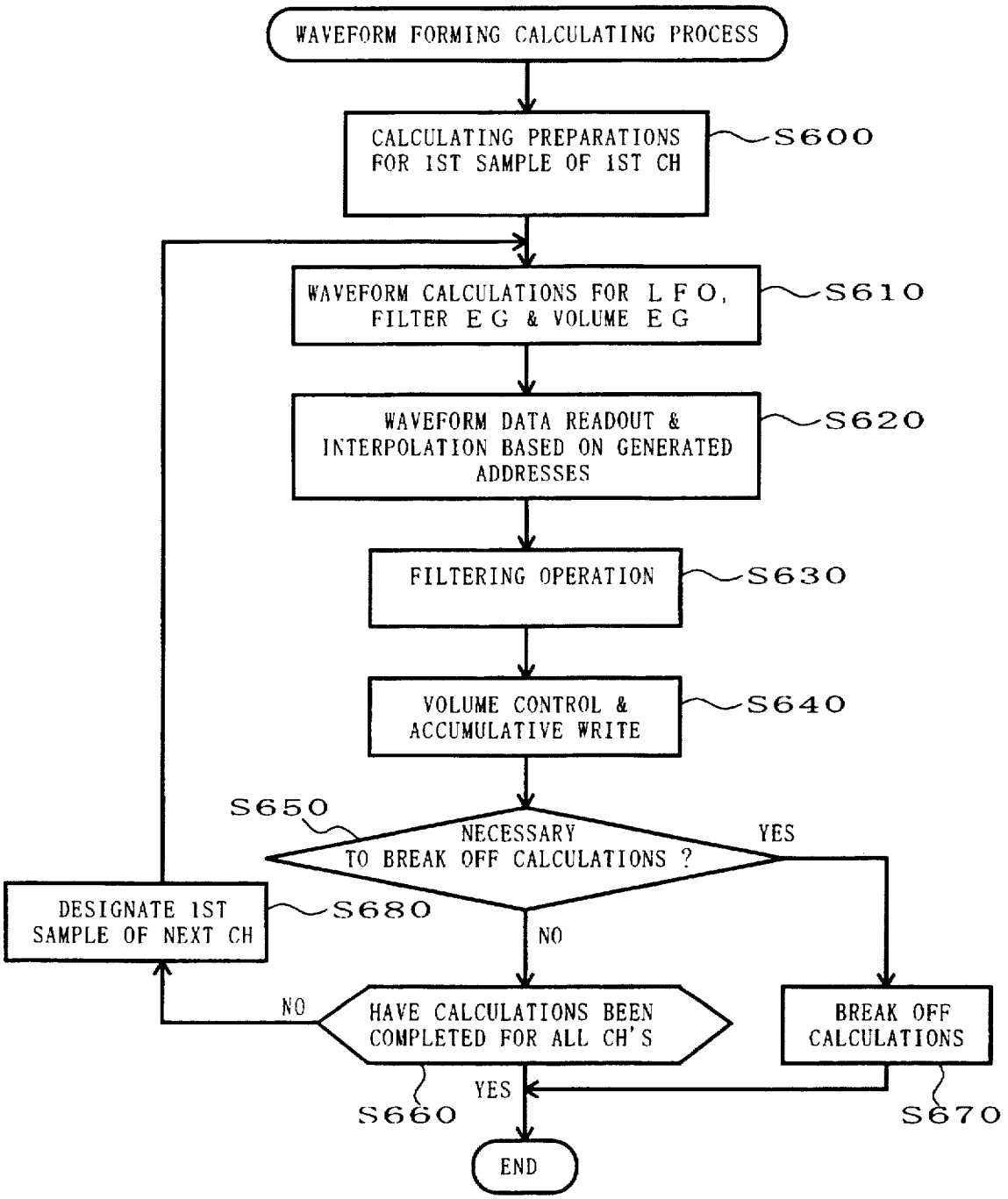
FIG. 11 is a is a flowchart of a waveform forming calculation process executed in the processes of FIGS. 9A, 9B and 10.

FIG. 11 is a flowchart of the waveform forming calculation process performed in the note-on, note-off and tone generator processes. For this process, a waveform calculating time range is preset as previously mentioned. Namely, where the present program flow is executed during the MIDI data reception process such as the note-on process, the waveform calculating time range corresponds to the above-mentioned partial waveform, but where the present program flow is executed during the tone generator process, the waveform calculating time range corresponds to the waveform samples for an uncalculated section in the buffer X. Because the calculations are performed in the calculating order determined by the preceding execution of the tone generator process, no new calculating order across the channels is determined at the time of MIDI data reception.

Whenever a new note-on event occurs and is assigned to a specific one of the channels, the specific channel is placed first (given a first turn) in the calculating order and the turn of each of the other channels is moved down by one.

First, at step S600, calculating preparations are made for a first waveform sample of the channel placed first in the calculating order. The calculating preparations include setting various data such as a last read address, values and states (attack, release, etc.) of various envelopes EG and value of LFO in accessible conditions and loading these data into internal registers of the CPU 1 for immediate use in calculations. Then, at step S610, waveform sample calculations are performed on the LFO, filter G and tone volume EG, so as to form samples of LFO, FEG (filter envelope) and AEG (amplitude envelope) waveforms. The LF0 waveform is added to the "F" number, FEG waveform and AEG waveform necessary for calculations of the designated time range, in order to modulate the respective data. For each of the tone generating channels designated as tone deadening channels, a damping AEG waveform is calculated as a tone volume EG rapidly decaying within the time range.

Subsequently, at step S620, F number is repetitively added to the last read address used as an initial value, so as to generate read addresses for individual samples within the time range. Also, waveform data are read out from the waveform storage region WD in the tone color data area on the basis of the integer portion of the read addresses, and an interpolation is made between the read-out waveform samples on the basis of the decimal portion of the read addresses so as to form all interpolated samples within the time range. For example, if the timer range corresponds to a time for 100 samples, 100 samples are formed collectively by the operation of this step. Because, in the operation for the plural samples within the time range, the F number addition corresponding to the read address and interpolation are performed as an integral series of operations, the read address needs to be read into the CPU register only once, so that the processing speed can be substantially increased as a whole.

Further, at step S630, the interpolated samples within the time range are subjected to a tone color filtering operation, where tone color control of the samples is performed on the basis of the above-mentioned FEG waveform. At next step S640, an amplitude controlling operation is performed on the filtered samples so as to control the amplitudes of the samples on the basis of the above-mentioned AEG (amplitude envelope) and tone volume data, and then an accumulative writing operation is performed to add the resultant amplitude-controlled samples to the corresponding samples stored in the output buffer X for the designated channels. Because, in this process, the amplitude control and addition to the corresponding samples in the output buffer X are performed successively, it is possible to minimize the number of necessary sample loadings into the CPU register and hence significantly increase the processing speed.

The sample forming operations of steps S620 to S640 are performed basically to form all the samples within the predetermined time range, but those samples having sufficiently lowered AEG waveform level and hence sufficiently lowered tone volume as a result of the volume EG waveform calculations of step S610 are excluded from the further calculations, and accordingly the amount of necessary operations can be reduced. Particularly, sufficient decay may often be attained halfway in the predetermined time range, in the case of the tone generating channels having generated a damping AEG waveform in response to the designation of step S540.

Then, at step S650, a determination is made as to whether or not the waveform will be supplied to the DMA 9 within the time limit if the waveform forming calculation process is to be continued and whether the waveform sample calculations should be discontinued. The timely supply of the waveform within the time limit means herein that the DMA 9 currently reproducing previously formed waveform samples from the specific storage area can prepare succeeding waveform samples in a new area of the buffer X and reserve the new area of the buffer X for subsequent reproduction before the reproduction of the previously formed waveform samples from the specific storage area is completed. If it is determined at step S650 that the waveform will not be supplied in time and the calculations should not be continued further, then the waveform sample calculations are discontinued at step S670 and the waveform calculating process ends.

If it is determined at step S650 that the calculations may be continued, a further determination is made at step S660 as to whether the waveform sample calculations have been completed for all of the designated channels. In answered in the negative, a first waveform sample in the tone generating channel placed next in the calculating order (given the next calculating turn) is designated at step S680 and preparations are made for calculating waveform samples in that next channel. Upon completion of such preparations, the CPU 1 reverts to step S610 so as to repeat the operations of steps S610 to S640 for that channel. In this way, the operations of steps S610 to S660 are repetitively performed for all the designated tone generating channels, and every time the operations are performed for one of the channels, the resultant formed samples for the predetermined time range are accumulatively added at step S640 to the corresponding samples stored in the buffer X.

When it is determined at step S660 that the waveform sample calculations have been completed for all of the designated channels, this waveform calculating process ends. Thus, a predetermined number of accumulated values of the formed waveform samples corresponding to the time range have now been newly stored for all of the designated channels.

When the waveform sample calculations are discontinued at step S670 on the basis of the affirmative determination at step S650, the predetermined number of accumulated values of the formed waveform samples corresponding to the time range have now been newly stored for each of the designated channels.

For each of the channels having the calculating turn later than the discontinuation of the calculations, no waveform sample formation is effected, and as the result, the tone having been generated through the channel will be deadened. However, because those channels generating less important tones are given later turns in the calculating order at step S530, adverse effects occurring from the discontinuation can be minimized. The channel register CH is set at step S670 in such a manner that the channels thus excluded from the calculations remain in the tone-deadened condition even in and after next execution of the waveform forming calculation process.

In the case where the above-described waveform forming calculation process is executed at step S340 of the note-on process flowcharted in FIG. 9A, the operation of step S350 is performed upon termination of this process, and then the note-on process ends. In the case where the above-described waveform forming calculation process is executed at step S430 of the note-off process flowcharted in FIG. 9B, the operation of step S440 is performed upon termination of this process, and then the note-off process ends. Further, in the case where the above-described waveform forming calculation process is executed at step S550 of the note-off process flowcharted in FIG. 10, the operations of steps S560 to S580 are performed upon termination of this forming process, and then the tone generator process ends.

These note-on, note-off and tone generator processes are repeated cyclically in the constant loop of the main routine of FIG. 6, so that waveform samples are formed sequentially for subsequent audible reproduction.

It should be obvious that in the tone generating method of the present invention, those steps processing data independent from each other, such as the step of instructing generation of a plurality of tones and the step of instructing a start of waveform sample calculations at predetermined time intervals, may be performed in any optional order rather than in the above-described order.

Further, according to the tone generating method of the present invention, operations requested from another application software, including a tone forming instruction, may be performed utilizing idle times in the waveform forming calculation process. In this case, the other application software may for example be game, communication or office work processing software.

The tone generating method of the present invention has been described above as a program executed by the tone generating device shown in FIG. 1. Alternatively, the tone generating method of the present invention may be implemented on a general-purpose computer based on an operating system (OS) such as "Windows" commercially available from Microsoft Corporation, U.S.A., as a single application program in parallel with another application program.

With the present invention having been described so far, the preparations in each channel need to be made only once for formation of a plurality of waveform samples, thus achieving substantial reduction in overheads. This enhances the quality of generated tones and permits an increase in the number of channels capable of simultaneously generating tones.

Further, by controlling the waveform sample calculations to take place each time a MIDI event is input, the calculations can be performed in a dispersed manner and it is possible to prevent the number of generated tones from being undesirably reduced by the initial tone forming operations.

In addition, with the arrangement that the performance information input or read-in operation is executed at the time of occurrence of the performance information, and tone control or waveform formation based on the read-in performance information is included in main steps executed in idle times during the read-in operation, increased processing amounts at the time of performance information occurrence can be dispersed within idle times, so that temporary increase in the processing amounts can be effectively avoided.

Next, with reference to FIGS. 13 to 25B, a description will be made hereinbelow about an embodiment according to a second aspect of the present invention.

In this embodiment, a general-purpose operating system, on which application programs such as sequencer and game software are operable, is caused to operate on a multitask management program, and a software tone generator is caused to operate under the control of the multitask management program rather than an application program. By virtue of such an arrangement, the software tone generator is allowed to reliably work at time intervals necessary for real-time processing, and while no processing is being executed in the software tone generator, the general-purpose operating system is allowed to operate so that the application program is executed on the operating system.

Figure 19:
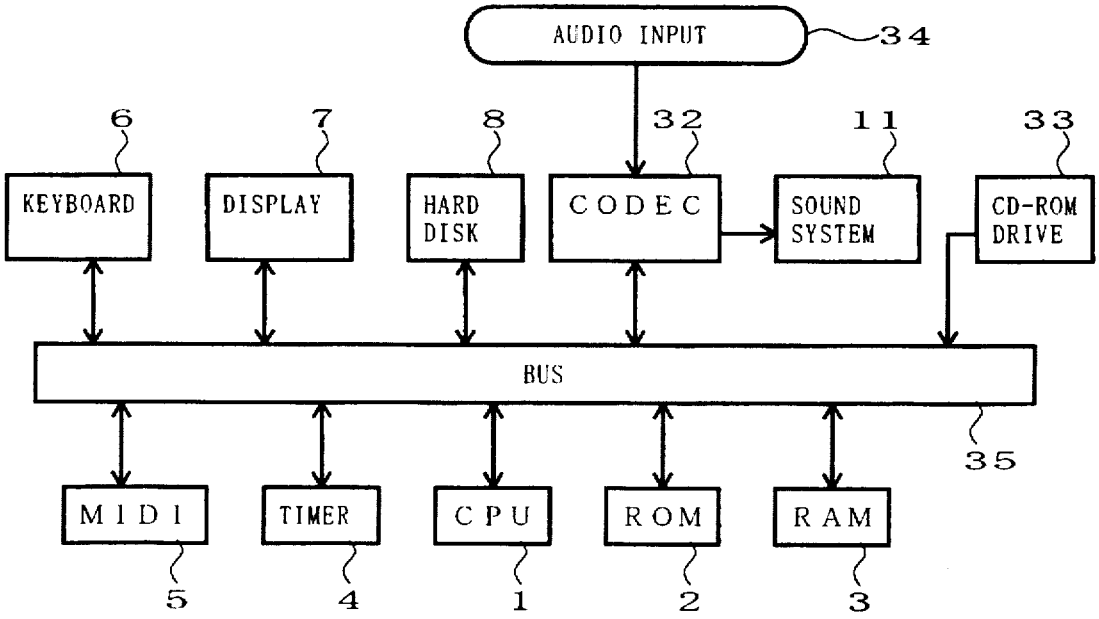
FIG. 19 is a block diagram illustrating an exemplary hardware setup of a processing device on which the tone generating method of the present invention is implemented.

In practicing the second-aspect embodiment, there may be employed a tone generating device comprising a hardware setup as shown in FIG. 1, or a tone generating device comprising a hardware setup as shown in FIG. 19. In the following description, the embodiment will be described on the assumption that the tone generating device of FIG. 19 is employed.

In FIG. 19, components denoted by the same reference characters as in FIG. 1 have substantially the same functions as the counterparts in the figure. This embodiment is essentially different from that of FIG. 1 in that it includes an input terminal 34 attached to a CODEC device 32 for inputting an external analog audio signal and that sound data is exchanged via the CODEC device 32 between a bus 35 of the CPU 1 and the sound system 11 or the input terminal 34. The CODEC device 32 contains a D/A converter (DAC) or an A/D converter (ADC). In response to each sampling clock pulse, digital tone waveform data formed via processing by the CPU 1 is supplied to the D/A converter via the bus 35 so that the supplied waveform data is converted into an analog signal to be fed to the sound system 11. Analog audio signal is input to the A/D converter via the input terminal 34 so that the supplied audio signal is converted into digital data to be fed to the bus 35. Such an analog audio signal inputting function of the input terminal 34 and analog-to-digital converting function are advantageously utilized when tone generator waveform data is to be sampled from the outside and stored in internal memory. The devices of FIGS. 1 and 19 may both be provided with an optional peripheral storage device such as a floppy disk drive, CD-ROM drive or MO (Magneto Optical Disk) drive. For example, a recording medium (such as a floppy disk or CD) storing programs for implementing the embodiment of the present invention may be set in the peripheral storage device so that any of the programs read out and transferred via the bus 35 to the hard disk 8 or the RAM 3 for storage therein. Then, by the CPU 1 executing the program, the present invention can be practiced in accordance with a desired program. In the illustrated examples of FIGS. 1 and 19, a CD-ROM drive 33 is provided for this purpose.

Figure 13:
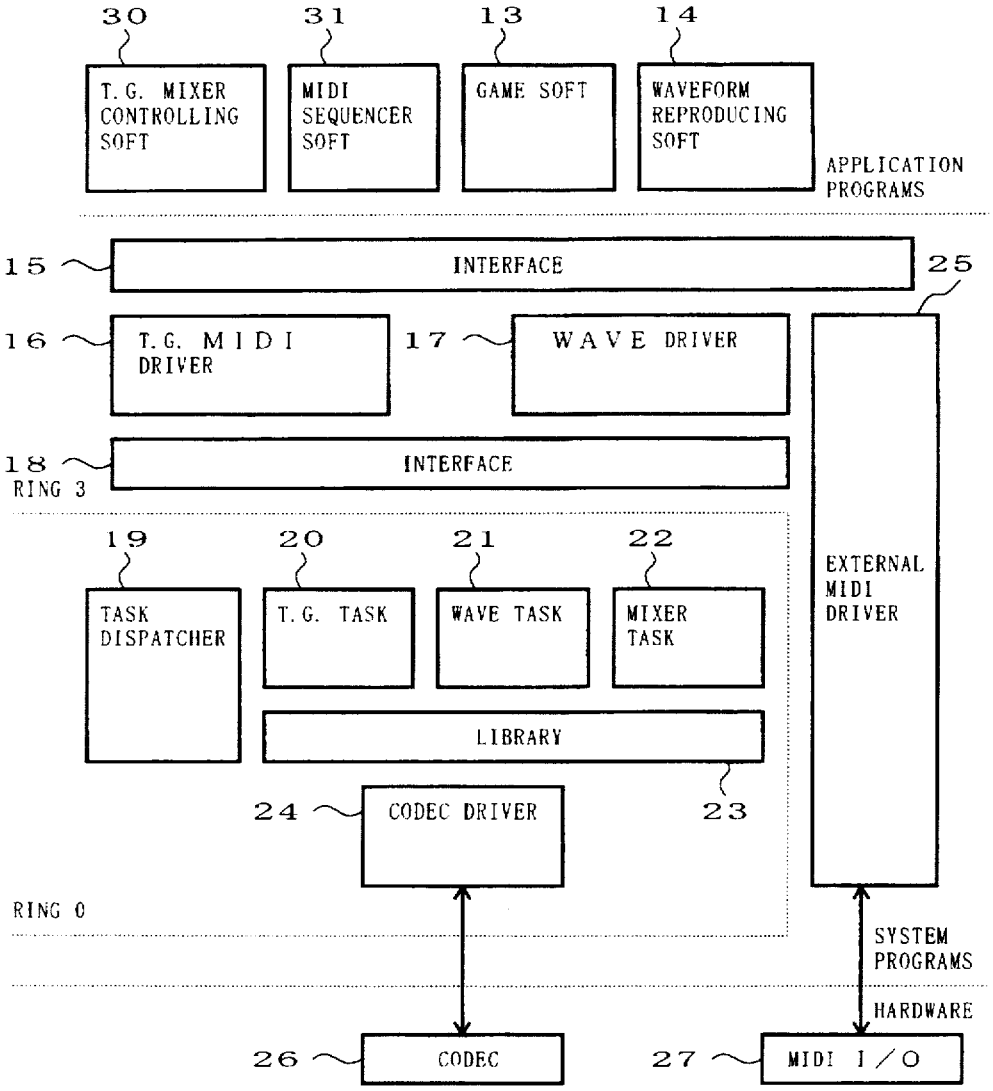
FIG. 13 is a block diagram illustrating a setup of software modules according to a second embodiment of the present invention.

FIG. 13 is a block diagram illustrating a setup of software modules in the embodiment, where for simplicity of illustration, there are only shown sections relating to audio signal processing that requires real-time data processing, i.e., sections relating to processing of the software tone generator and waveform data.

As shown, a group of application programs including tone generator (T. G.) mixer controlling software 30, MIDI sequencer software 31, game software or the like 13 and waveform reproducing software 14 are situated in the top layer. Below the application programs, there are situated a group of system programs including: an interface 15 through which the application programs can utilize various services provided by the system program group; a tone generator (T. G.) MIDI driver 16 functioning as a MIDI tone generator driver to form a tone generator (T. G.) task 20 as will be later described; a wave input/output driver 17 having a function to open a wave input/output device; an interface between the tone generator MIDI driver 16 and wave input/output driver 17 and a kernel (Ring 0); and an external MIDI driver 25. These programs are executed when a processor is in a user mode (Ring 3).

The system software group further includes a task dispatcher 19, the tone generator task 20, a wave task 21, a mixer task 22, a library 23 comprised of a group of subroutines for performing mixing, division and sample rate conversion or format conversion of audio signal streams, and a CODEC driver 24. These programs are executed when the processor is in a kernel mode (Ring 0).

The task dispatcher 19 is a module for performing control such that a task to be performed next is selected from among a plurality of ready tasks (processes) and then actually performed by the processor. In the present invention, the task dispatcher 19 performs task scheduling based on a so-called preemptive method (complete multitask method).

As will be later described more fully, the tone generator task 20 is created by the tone generator MIDI driver 16 and provides a waveform table synthesizing function and a tone color control processing function for designated channels (32 channels at the maximum) on the basis of tone controlling parameters TGPARA supplied from the MIDI driver 16. Further, the wave task 21 and mixer task 22 are created in correspondence with a wave input/output device that is opened by the wave input/output driver 17. Reference numeral 26 represents a CODEC circuit including A/D and D/A converters for inputting and outputting waveform data, and 27 represents a MIDI interface (MIDI I/O). Although not specifically shown, the system program group further includes disk drivers, memory managing program, file system, user interface, etc. which are generally contained in a general-purpose operating system.

Figure 14:
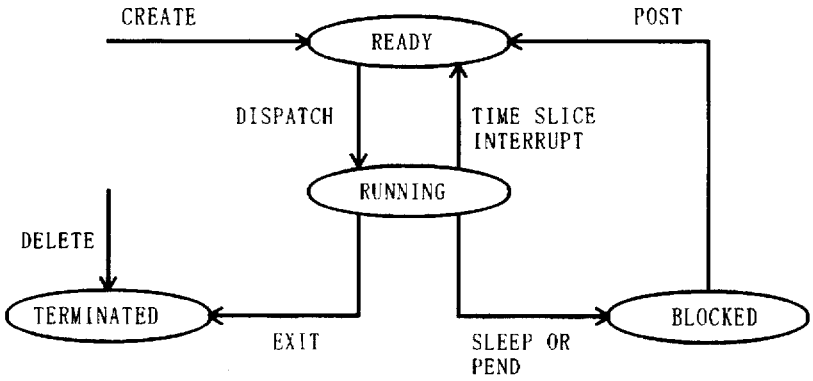
FIG. 14 is a diagram illustrating how a specific task is executed in the embodiment.

Next, with reference to FIG. 14, a description will be made about how a specific task (process) is executed in the embodiment according to the second aspect. A task is created by executing a CREATE instruction, and the created task is placed in a "ready" state and then put in a queue. In accordance with predetermined priority order, the task dispatcher 19 selects one of the ready tasks from the queue for which processing is to be initiated, and the selected task is placed in a "running" state. In this state, once a time slice interrupt is generated from a timer or the like, the running task is interrupted and again placed in the "ready" state and put in a queue. Then, the task dispatcher 19 selects one of the tasks from the queue for which processing is to be initiated next, and controls such that the selected task is executed.

Therefore, even when a specific task is running, the task is interrupted compulsorily by a time slice interrupt or the like that is generated at a predetermined frequency. By giving the tone generator task 20 higher priority, the tone generator task 20 can be executed reliably at predetermined time intervals. Other tasks such as the wave task 21 requiring real-time processing can be executed in a similar manner on a general-purpose computer. In addition, whenever no real-time processing is not being performed, a general-purpose operating system can operate as a single task and thus an application program operating on the operating system can be executed in parallel with the real-time processing.

Once an instruction awaiting occurrence of a particular event such as a SLEEP or PEND instruction is executed while a task is running, this task is placed in a "blocked" state and another task is dispatched. Then, when the particular event occurs, the "blocked" task is again placed in the "ready" state and put in a queue. Subsequently, when an EXIT or DELETE instruction is executed, the task is placed in a "terminated" state.

With the above-mentioned arrangement, the tone generator MIDI driver 16, tone generator task 20, CODEC driver 24 and CODEC circuit 26 cooperate to realize the software tone generator of the present invention.

The tone generator MIDI driver 16 is activated when a MIDI signal is input from the MIDI sequencer software 12 or the like via the interface 15. Once activated, the tone generator MIDI driver 16 performs processing such as a note-on process, note-off process, program change, control change, system-exclusive process or the like, depending on the MIDI signal input. In the case of a note-on event, the tone generator MIDI driver 16 assigns a new tone to one of the channels of the tone generator task 20 functioning as a tone generator and prepares tone controlling parameters and note-on data to be set in the assigned or designated channel. The tone controlling parameters are parameters obtained by processing parameters of tone colors, selected for individual MIDI channels, in accordance with a note number and performance touch accompanying the note-on event. The prepared tone controlling parameters are forwarded to tone generator registers in the tone generator task 20 when the task 20 is activated.

The tone generator task 20 has a waveform table synthesizing function for any of 32 channels and a reverberation function of monaural input/stereo output, and the task 20 is activated for each frame time in response to a waveform data request from an output device comprising the CODEC driver 24 and CODEC circuit 26. The tone generator task 20 receives an external audio input and executes a reverberation process on the external audio input and waveform table synthesizing data formed thereby, so as to provide a resultant audio waveform to the output device.

Figure 15:
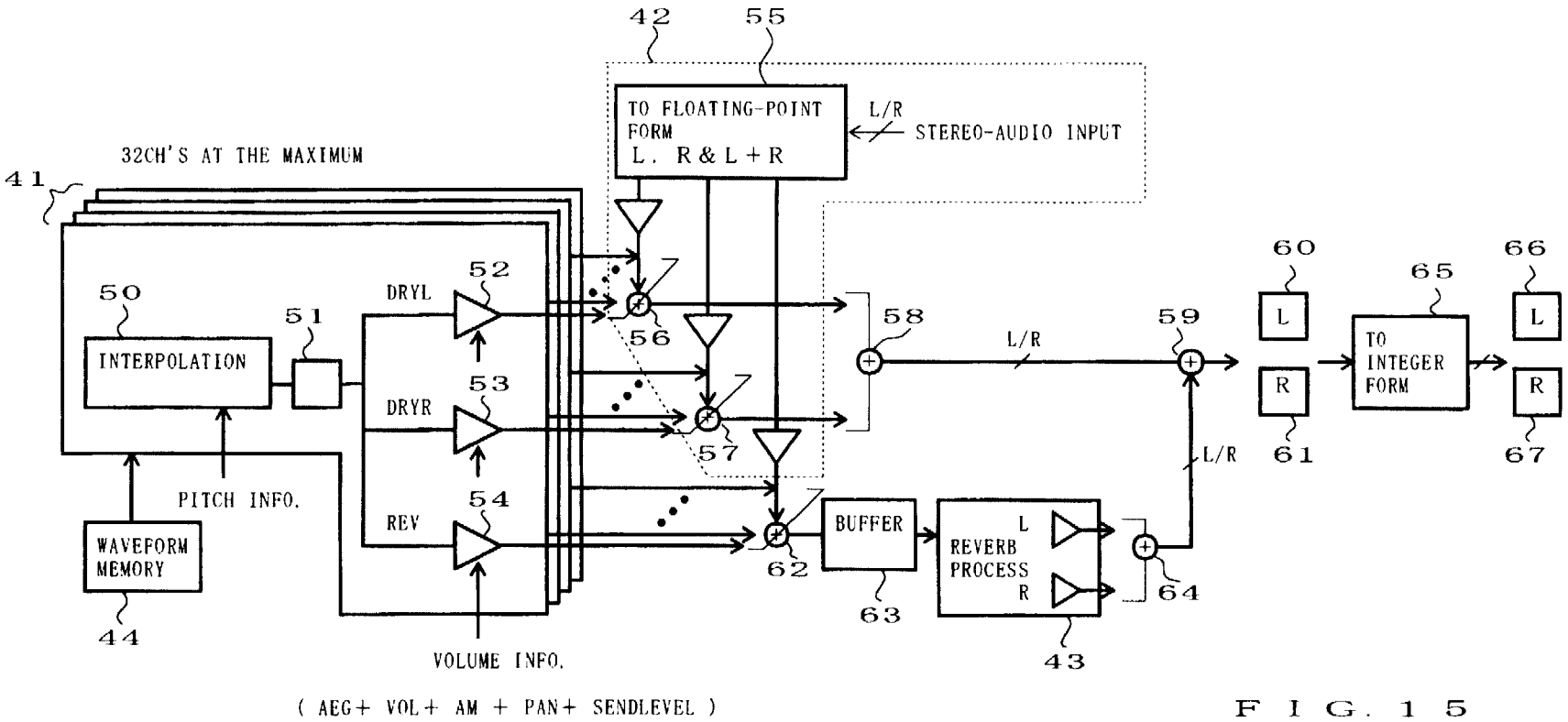
FIG. 15 is an equivalent circuit diagram illustrating overall processing in a tone generator task of FIG. 13.

FIG. 15 is an equivalent circuit diagram illustrating overall processing in the tone generator task 20, where 41 represents a waveform table synthesizing process for any of 32 channels, broken-line block 42 represents an external-stereo-audio-signal input process, and 43 represents a reverberation process. Further, 44 represents a waveform data memory, 50 an interpolation operation section, 51 and 65 data converting sections, and 52, 53 and 54 multiplier sections. 55 represents a data converting section which receives stereo-audio input signals expressed in integer data form and converts the received data into data expressed in floating-point form and then outputs left-channel signal L, right-channel signal R and a signal indicative of the sum of the left- and right-signals L+R. Further, 56, 57, 59 and 62 represent adder sections, 58 and 64 adder sections for interleaving data, 60, 61, 63, 66 and 67 buffers, and 65 a data converting section for converting data expressed in floating-point form to data expressed in integer data form. The stereo-audio input signal to be supplied to the data converting section 55 may be either one from the CODEC circuit 26 or one sent from the waveform reproducing software 14 via the wave input/output driver 17.

Whereas the conventional hardware tone generators form waveform data for each sample and subject it to D/A conversion, the software tone generator and audio input/output of the present invention process waveform data frame by frame. The term "frame" as used herein is a basic unit of a given process, and the software tone generator and audio input/output of the present invention allocate a buffer area for a predetermined number of samples corresponding to a reproduction period of about 5 ms and use it as a frame. The size of this buffer depends on a waveform calculating frequency (sampling frequency). In FIG. 15, each of the buffers 60, 61, 63, 66 and 67 has a capacity of one frame.

Further, in FIG. 15, thick-line arrows each represent 32-bit data expressed in floating-point form, while thin-line arrows each represent 16-bit integer data. Each of the buffers 60, 61, 63 denoted in a thick-line rectangular block is provided for storing the 32-bit data expressed in floating-point form, and each of the buffers 66 and 67 denoted in a thin-line rectangular block is provided for storing the 16-bit integral data.

In the CPU employed in this system, floating-point multiplications can be performed more rapidly than integer multiplications, and thus signal processing is effected in floating-point form whenever possible. However, because most of the waveform data stored in the waveform data memory 44 are 8-bit integer data, the interpolation operation section 50 effects multiplications in integer form, and then the data converting section 51 converts the resultant multiplied data into floating-point representation, in order to reduce necessary execution time.

The waveform table synthesizing process 41 basically comprises waveform interpolation and gain adjustment. Waveform data read out from the waveform data memory 44 are interpolated by the interpolation operation section 50 using pitch information supplied from the tone generator MIDI driver 16, and each of the resultant interpolated data is converted by the data converting section 51 into floating-point representation. The output from the converting section 51 is passed to three output channels, i.e., divided into left channel signal L, right-channel signal R and reverberation input signal L+R, which are the delivered to the respective multiplier sections 52, 53 and 54 to be multiplied by volume information supplied from the tone generator MIDI driver 16; the volume information is data obtained by multiplying tone volume envelope signal of the individual tone generating channels by levels of the three output channels. The waveform data output from the individual tone generating channels are added together via the adder sections 56, 57 and 62 to which are also supplied, from the data converting section 55, the left-channel signal L, right-channel signal R and sum of the left- and right-channel signals L+R of the external stereo-audio input signals, respectively. Thus, the adder sections 56, 57 and 62 mix the waveform data of all the channels with the external stereo-audio input signals.

The output data from the adder sections 56 and 57 are stored into DRYL buffer 60 and DRYR register 61, respectively, and the output data from the adder section 62 is stored into a reverberation (REV) buffer 63. The "L+R" data thus stored in the reverberation buffer 63 is passed to the reverberation process 43 for reverberation operations. The resultant reverberated data (reverberated sound data) is subjected to gain control independently for the left and right channels L and R and then added to the data stored in the buffers 60 and 61, respectively. After that, the reverberated data is further converted by the data converting section 65 into integer form and supplied, as audio output data, to a D/A converter of the CODEC circuit 26 via the buffers 66 and 67.

Processing timing of these operations will be explained with reference to FIG. 16, where the horizontal axis is a time axis, and [A] above the time axis represents processing in the tone generator MIDI driver 16 while [B] below the time axis represents processing in the tone generator task 20. Further, in FIG. 16, first and second lines from the bottom represent input/output audio data streams, and "audio input device" is a waveform data input routine for receiving and converting into digital form waveform data supplied from the CODEC circuit 26 while "audio output device" is a waveform data output routine for converting into analog form and outputting waveform data to the CODEC circuit 26.

The entire processing in the present system can be divided into three major processes in terms of their processing priority. The group having the first or highest priority is the process of the tone generator MIDI driver 16 activated by a MIDI signal given as a time interrupt signal, during which conversion from the MIDI signal into the tone controlling parameters is executed. This process of the tone generator MIDI driver 16 is, however, given the third or lowest priority when the MIDI signal is received directly from the application program rather than as a timer interrupt. The second priority is given to the tone generator task 20, which is activated by a READY message from an audio input/output buffer (i.e., an OUTPUT READY message generated from the audio output device when it requests next data, or an INPUT READY message generated from the audio input device when it is ready to send data), a TG PARA RECEIVED message generated from the tone generator MIDI driver 16 when sending new tone controlling parameters message, or a WAVE LOAD REQUEST message generated from the tone generator MIDI driver 16 when loading waveform data. The MIDI sequencer software and other application programs are given the lowest priority.

Figure 16:
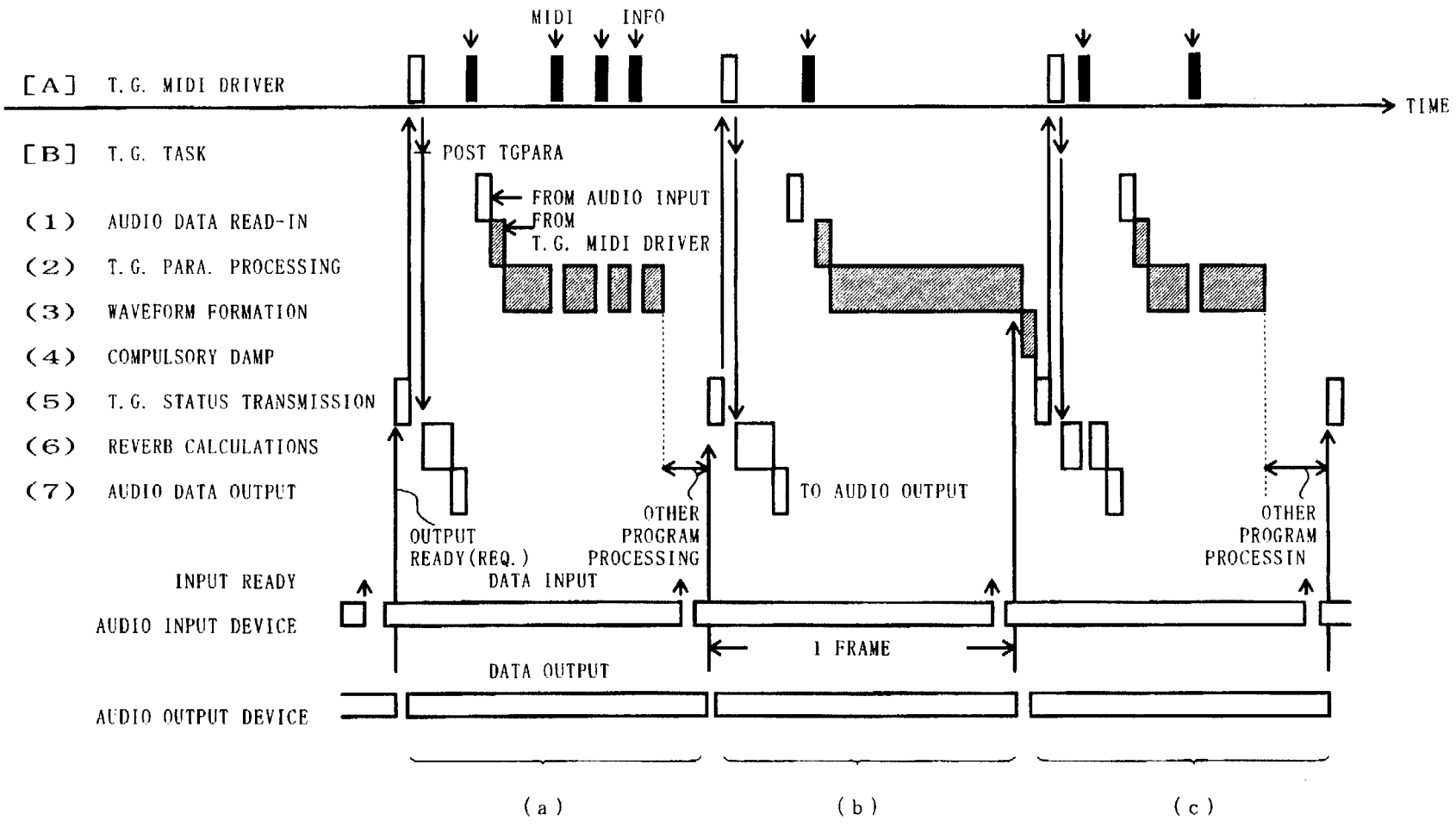
FIG. 16 is a diagram explanatory of processing timing of various operations to generate tones.

In processing [B] in the tone generator task 20 of FIG. 16, data processing for one frame comprises operations for: (1) reading input audio data; (2) processing tone controlling parameters; (3) forming waveforms for 32 channels; (4) effecting compulsory damping if necessary; (5) sending a tone generator status; (6) performing reverberation calculations; and (7) forwarding data as audio output data. Of these operations, the waveform calculating operation for 32 channels at item (3) above involves a heaviest load on the CPU and a greatest fluctuation, and hence it is very likely that the necessary calculations will not be completed within one-frame period. In view of this, it is reasonable to perform such an uncertain operation last of all the operations, and therefore the present system is arranged to start the processing with the item (5) operation rather than the item (1) operation.

The item (5) to item (7) operations are designed as a series of operations which is activated by the OUTPUT READY message from the audio output device. Once the OUTPUT READY message is received and the tone generator task 20 is activated, a tone generator status (TG STATUS) indicative of an operational status of the task 20 is sent to the tone generator MIDI driver 16 in the item (5) operation in order to invoke a CALL BACK function of the MIDI driver 16. In the CALL BACK function, the tone generator MIDI driver 16 reads the TG STATUS and sets, into tone generator registers of the tone generator task 20, tone forming parameters TG PARA including tone controlling parameters and note-on signal prepared for the task 20. Then, the tone generator task 20 initiates the reverberation calculations at item (6), where reverberation calculations are performed using the waveform data stored in the buffer 63 and the resultant calculated data are added into the buffers 60 and 61 each having one-frame capacity. After that, the tone generator task 20 initiates the audio data output operation of item (7) above, where the waveform data stored in the DRYL buffer 60 and DRYR buffer 61 are converted into one-frame waveform data to be delivered to the output driver. Then, the series of the operations is terminated.

After the item (7) operation comes the audio input operation of item (1) which is activated by the INPUT READY message. Because, in effect, the input data has got ready before the output data as shown in FIG. 16, the item (1) operation is called following the item (7) operation. In the audio input operation, one-frame input data are read in from the audio input device or wave input/output driver 17.

Finally, the item (2) to item (4) operations are performed as a series of operations which is activated by a message acknowledging receipt of the tone forming parameters TG PARA. Because, in effect, the tone forming parameters TG PARA have been received prior to the item (6) operation, these item (2) to item (4) operations are activated following the item (1) operation. In the item (2) operation, the tone forming parameters TG PARA including tone controlling parameters and note-on signal stored in the tone generator registers by the tone generator MIDI driver 16 are interpreted and converted into waveform calculating data. Then, in the item (3) operation, the waveform forming calculation process is performed for any of the 32 channels. The waveform forming calculation process is effected by, for each of the designated channels, reading out the waveform data while advancing the read address of the waveform data memory 44 at a rate corresponding to the pitch of tone to be generated, interpolating between the read-out sample data and then executing tone volume control on the interpolated data on the basis of volume information such as a tone volume envelope (AEG). The tone control is made on the left channel L, right channel R and reverberating channel L+R independently of each other, and the one-frame volume-controlled waveform data for the three channels are added into the respective buffers 60, 61 and 63.

The processing for the frame in question is terminated by completion of the item (3) operation, and then the general-purpose operating system is caused to operate until the next OUTPUT READY message. As shown in part (b), even when the next OUTPUT READY message is received, the waveform forming calculation process is compulsorily discontinued if the item (3) waveform formation is not completed, and at this time, the compulsory damping is effected for uncalculated channels so as to prevent occurrence of unwanted click noise. According to the embodiment, the waveform calculating operation for any of the 32 channels is performed sequentially for the designated channels, starting with a specific one of the channels which, for example, is currently sounding a tone of relatively high level that will thus exert appreciable effects if compulsorily discontinued in the above-mentioned manner.

When, during execution of the tone generator task 20, a MIDI event is generated by a timer interrupt of higher priority, the control is compulsorily shifted to the tone generator MIDI driver 16, and operations corresponding to the MIDI event are performed as shown in part [A] of FIG. 16, in which occurrence of seven MIDI events is depicted by downward arrows.

The above-mentioned tone generator task 20 will be further described with reference to flowcharts of FIGS. 17, 18A and 18B.

Figure 17:
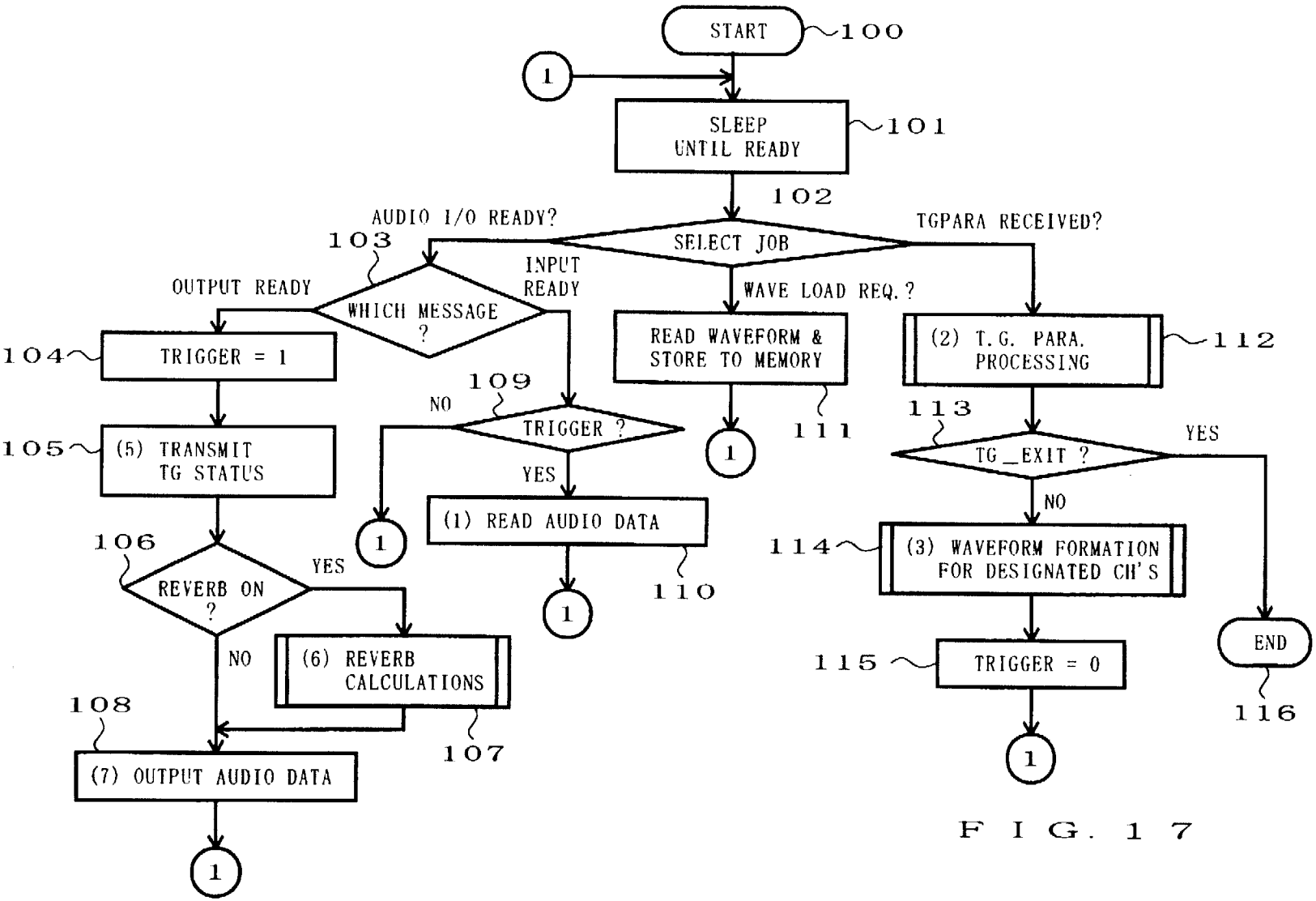
FIG. 17 is a flowchart of the tone generator task.

First, this tone generator task 20 is generated at step 100 of FIG. 17, and the generated tone generator task 20 is placed in a SLEEP state at step 101. The tone generator task 20 placed in the SLEEP state is awaken by occurrence of an event, such as reception of a message, into a READY state, and when the task 20 in the READY state is dispatched by the task dispatcher, the program proceeds to step 102 in order to determine the event. That is, it is determined at step 102 whether the event is (a) a READY message from the audio input/output device, (b) a WAVE LOAD request from the tone generator MIDI driver 16, or (c) a acknowledging message of the parameters TG PARA from the MIDI driver 16.

If the event is the READY message from the audio input/output device as determined at step 102, the program branches to step 103, where a further determination is made as to whether the message is an OUTPUT READY from the audio output device or an INPUT READY message from the audio input device. If the message is the OUTPUT READY from the audio output device, a trigger flag is set to "1", and a TG STATUS is transmitted to the MIDI driver 16 at step 104 (item (5) operation of FIG. 16)—the trigger flag is set to "0" when the item (3) waveform forming calculations are terminated and set to "1" when an OUTPUT READY message is received—. Then, at step 106, it is determined whether the reverberation effect is ON or not. If answered in the affirmative at step 106, the reverberation calculations (item (6) operation of FIG. 16) is performed at step 107 and then the program proceeds to step 108; otherwise, the program proceeds directly to step 108 without performing the operation of step 107. Audio data is output at step 108 (item (7) operation of FIG. 16), and the program reverts to step 101 to get back the SLEEP state.

If the event is the INPUT READY message from the audio input device as determined at step 103, the program proceeds to step 109 to ascertain the state of the trigger flag. If the trigger flag is at "1", the program goes to step 110 to read in the audio input data (item (1) operation of FIG. 16) and then reverts to step 101 to get back the SLEEP state. If the trigger flag is at "0" as determined at step 109, the program reverts to step 101 to get back the SLEEP state. As previously mentioned, the trigger flag is set to "0" when the item (3) waveform forming calculations are terminated and set to "1" when the OUTPUT READY message is received. Thus, by ascertaining the current state of the trigger flag at step 109, control can be made to prevent processing on the INPUT READY message from being performed prior to processing on the OUTPUT READY message. If the event is the WAVE LOAD request from the tone generator MIDI driver 16 as determined at step 102, the program proceeds to step 111 to read in and store the waveform data into memory and then reverts to step 101 to get back the SLEEP state. The WAVE LOAD request is a message generated from the MIDI driver 16 for initialization of the tone generator task 20 or the like.

If the event is the acknowledging message of the parameters TG PARA as determined at step 102, the program proceeds to branches to step 112, where processing is performed on the tone controlling parameters TG PARA set in the tone generator registers by the MIDI driver 16 (item (1) operation of FIG. 16). More specifically, tone generator controlling parameters, such as waveform data memory address, pitch information, EG (envelope) parameters, panning data and LFO controlling data, are determined from the received tone controlling parameters TG PARA. Then, the program moves to step 113 to determine whether the current state is TG_EXIT. With an affirmative determination, the task is terminated at step 116; with a negative determination, the program goes to step 114, where the waveform forming calculation process is performed for the designated channels (32 channels at the maximum) (item (3) operation of FIG. 16), as will be described in more fully with reference to FIGS. 18A and 18B. After the waveform forming calculation process of step 114, the program proceeds to step 115 to reset the trigger flag to "0" and then reverts to step 101 to get back the SLEEP state.

Figure 18B:
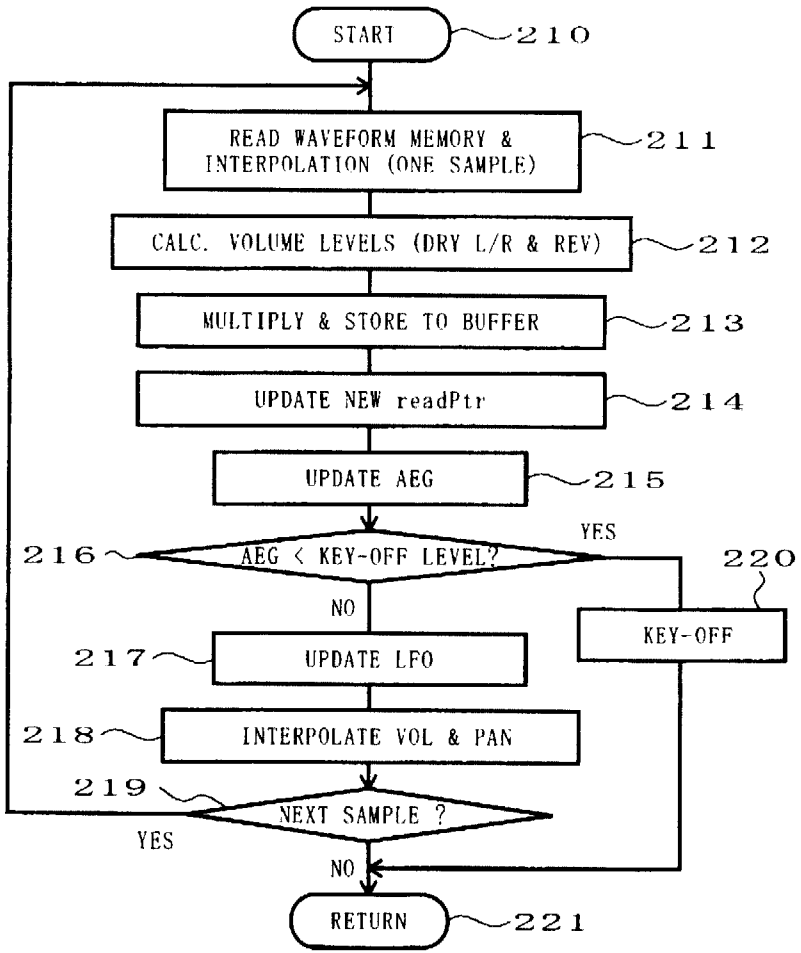
FIGS. 18A and 18B are flowcharts of waveform forming calculation process.
Figure 18A:
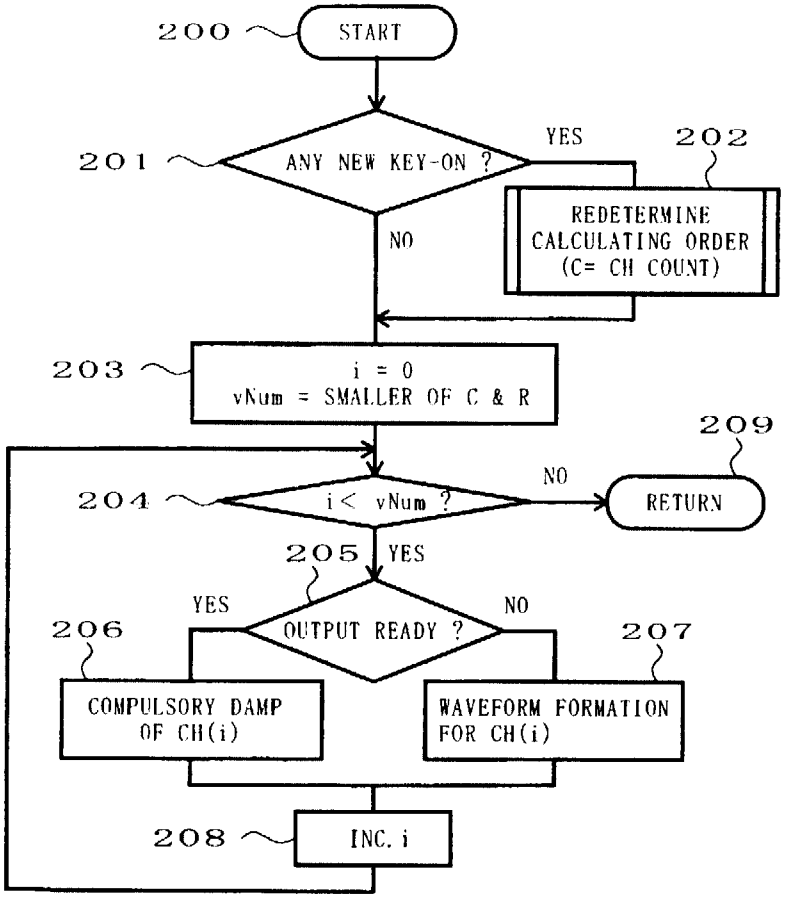

With reference to FIGS. 18A and 18B, the waveform forming calculation process performed at the above-mentioned step 114 will be described hereinbelow in greater detail. Upon start of the waveform forming calculation process at step 200, it is first determined at step 201 whether there has occurred any new key-on data. If there is new key-on data as determined at step 201, the program goes to step 202 to redetermine the calculating order of the tone generating channels. This is because the calculations may sometimes be discontinued on the way in response to the OUTPUT READY request as mentioned earlier and hence the calculations for important channels must have been completed beforehand. In the following description and in the figures, "C" represents the number of tone generating channels counted by the channel register.

After this step 202, or if there is no new key-on data as determined at the preceding step 201, the program proceeds to step 203, where the counter i for counting the number of the channels for which the waveform forming calculation process has been performed is set to "0", and the smaller of the number of the channels C and the number of channels R permitted to simultaneously generate tones is set as a variable vNum. The variable vNum is a variable indicating the number of the channels for which the calculations are to be performed. After that, the program proceeds to step 204 in order to determine whether the counted value of the counter i is smaller than the variable vNum. If answered in the negative, i.e., if the counted value of the counter i is equivalent to or greater than the variable vNum, the waveform forming calculation process is terminated at step 209.

If answered in the affirmative, i.e., if the counted value of the counter i is smaller than the variable vNum as determined at step 204, the program proceeds to step 205 to further determine whether there has occurred an OUTPUT READY request. With an affirmative determination, the program goes to step 206 to effect the compulsory damping on tone signals of the channel CH(i) (item (4) operation of FIG. 16). If answered in the negative at step 205, the waveform forming calculation process is performed for the channel CH(i) at step 207, as will be described in detail with reference to FIG. 18B. After the compulsory damping of step 206 or the waveform forming calculation process of step 207, the program proceeds to step 208 to increment the number i and then reverts to step 204 so as to repeat the operations of steps 204 to 208 for the next channel i+1.

A detail of the waveform forming calculation process for each channel will be described with reference to FIG. 18B. This waveform forming calculation process forms waveform data for one sample for "i" channel through a series of operations of steps 211 to 218. Thus, waveform data for a plurality of samples are formed by repeating these operations. Upon start of the waveform forming calculation process at step 210, necessary waveform data for one interpolated sample are read out from the waveform data memory in accordance with the integer portion of the read addresses (readPtr) already calculated at step 214 in the last execution of the waveform forming calculation process, and interpolating calculations are made between the read-out waveform data in accordance with the decimal portions of the addresses, so that one interpolated sample is formed. At next step 212, a calculation is made of the volume levels of data to be added into the DRYL buffer 60, DRYR buffer 61 and REV buffer 63. This volume level calculation is effected by adding parameters of tone volume envelope AEG, tone volume VOL, modulation AM.W panning value PAN and the levels of the three channels SENDLEVEL. Then, at step 213, the respective volume levels of the three channels are multiplied by the corresponding interpolated data, and the multiplication results are then added into the respective buffers.

After that, the program proceeds to step 214 to create a new read address readPtr for reading the waveform data memory 44 by adding the "F" number (pitch information). By thus incrementing the read address readPtr at a rate corresponding to the F number, a waveform having a pitch corresponding to the F number will be read out from the waveform data memory (waveform table). In this case, if the F number has a decimal portion, finer pitch control can be achieved. Then, the program proceeds to step 215 to update the tone volume envelope AEG. At next step 216, a determination is made as to whether the updated tone volume or amplitude envelope AEG is smaller than a predetermined key-off level. If answered in the negative at step 216, the program proceeds to step 217 to update the LFO and then goes to step 218 to execute a smoothing operation on the tone volume parameter VOL and panning parameter PAN (i.e., interpolating operation). Details of these steps 215, 217 and 218 will be described later. At next step 219, it is determined whether there is still any other sample to be formed, i.e., whether formation of one-frame waveform samples for the channel in question has not yet been completed. With an affirmative determination at step 219, i.e., if there is still any other sample to be formed, the program reverts to step 211; if answered in the negative, it means that the waveform forming calculation process has been completed for all the samples for the channel, and thus at step 221, the program terminates the waveform forming calculation process of step 207 for the channel.

If, on the other hand, the updated tone volume value is smaller than the predetermined key-off level as determined at step 216, the program goes to step 220 so as to execute a key-off process to place that channel in a tone deadening state. At next step 221, the program terminates the waveform forming calculation process of step 207 for the channel.

Figure 25A:
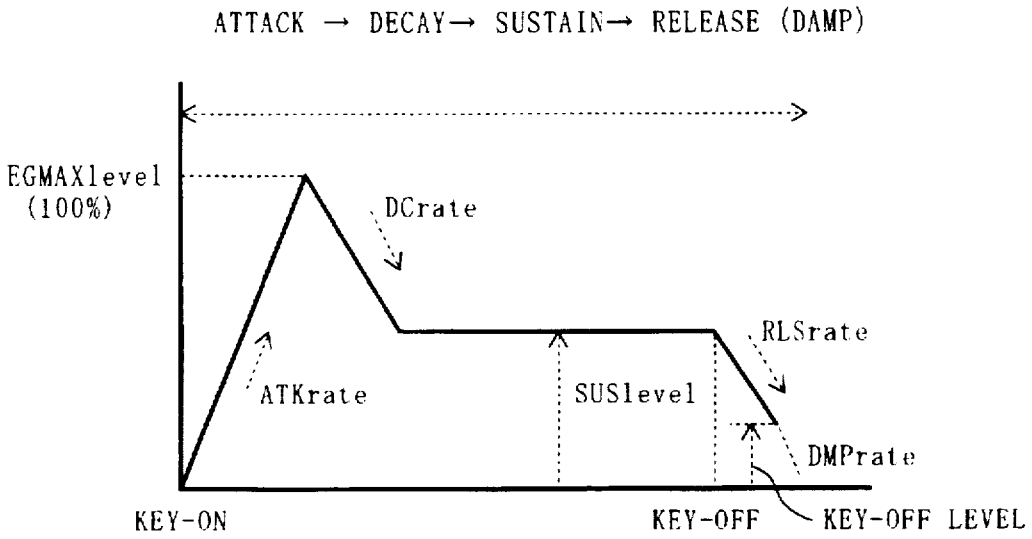
FIGS. 25A and 25B are diagrams illustrating examples of envelope and low-frequency-signal waveforms.

The above-mentioned envelope and LFO waveforms will be explained with reference to FIGS. 25A and 25B. FIG. 25A shows a typical example of the envelope (EG) waveform which comprises an attack, decay, sustain and release segments. More specifically, once a key-on event occurs, the waveform amplitude rises rapidly to a maximum level (EGMAXlevel) with an attack rate (ATKrate) slope (attack segment), decrease from the maximum level to a sustain level with a decay rate (DCrate) slope (decay segment), and then keeps a constant sustain level (SUSlevel) for a given time (sustain segment). Upon receipt of key-off event dada, the waveform amplitude attenuates with a release rate (RLSrate) slope. Then, once the amplitude reaches a key-off level inaudible to human ears, it is attenuated rapidly at a damp rate (DMPrate) to prevent unwanted click noise.

Figure 25B:
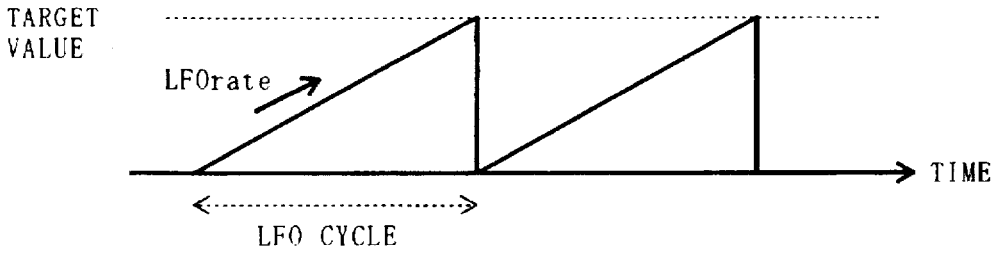

The LFO (Low Frequency Oscillator) waveform is used to obtain a waveform for modulating a tone waveform and, in effect, is a sawtooth wave having an LFO period determined by slope LFOrate as shown in FIG. 25B. By referring to a table or performing arithmetic operations using the LFO waveform, the necessary modulating waveform such as a sine wave can be obtained.

These EG waveform and LFO waveform change much more slowly than the tone waveform sampling cycle. Whereas, in the waveform forming calculations shown in FIG. 18B for the "i" channel, the amplitude EG and LFO are updated (steps 215 and 217) and interpolating operation of volume and panning values are executed (step 218) for each sample, these calculations may be performed once for every plurality of sampling cycles rather than for each sampling cycle, because the EG waveform and LFO waveform change much more slowly than the tone waveform sampling cycle as mentioned. By so doing, it is allowed to reduce the amount of necessary calculations for the waveform formation.

Figure 20:
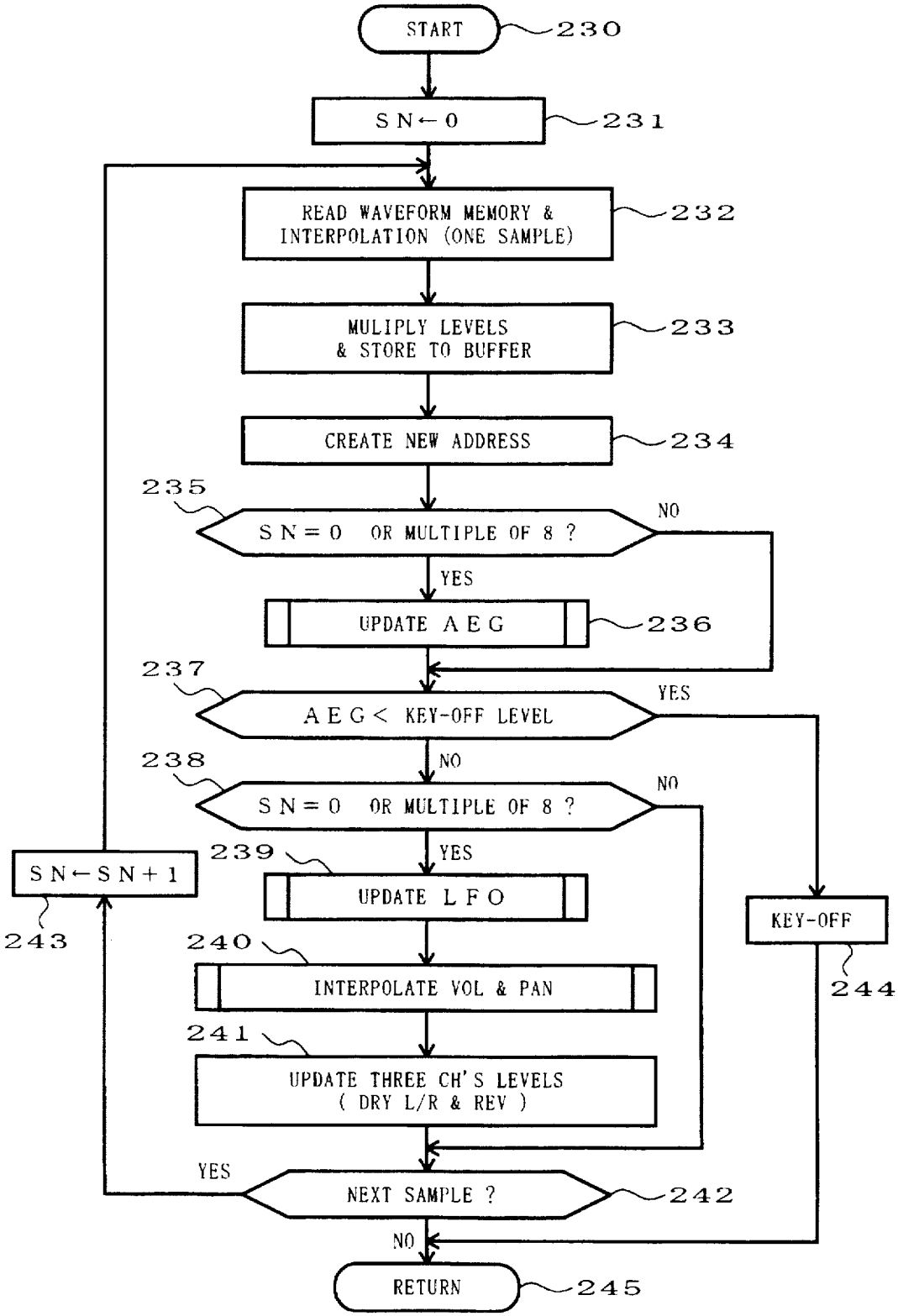
FIG. 20 is a flowchart illustrating another embodiment of the waveform forming calculation process.

In FIG. 20, there is shown a modified embodiment of the waveform forming calculation process for the "i" channel, which performs the above-mentioned amplitude EG and LFO updating and volume and panning parameter interpolations once for every eight samples. However, it should be understood that the frequency of these operations need not necessarily be performed once for every eight samples and any optimum frequency may be selected depending on the processing speed or load of the CPU. Upon start of the waveform forming calculation process for the "i" channel at step 231 in FIG. 20, a counter SN for counting samples is reset to "0" at step 231, and at next step 232, necessary waveform samples are read out from the waveform data memory and subjected to interpolation operations in a similar manner to the above-mentioned step 211. Then, at step 233, respective volume levels already calculated at step 250 in the last execution of the calculation process are multiplied by the corresponding interpolated data, and the multiplication results are added into the buffers of the corresponding channels. After that, the program proceeds to step 234 to create a new read address for reading the waveform data memory.

Then, at step 235, a determination is made as to whether the counted value of the counter SN is "0" or a multiple of "8". If answered in the affirmative at step 235, it means that the EG and LFO calculations are to be performed on the current sample, and thus the program proceeds to step 236 to update the amplitude EG (AEG) and then to step 237. If, on the other hand, the counted value of the counter SN is not "0" or a multiple of "0", the program proceeds to step 237 without updating the AEG. At step 237, it is further determined whether the current AEG value is smaller than the key-off level. If answered in the negative, the program proceeds to step.238 to further determine, similarly to step 235, whether the EG and LFO calculations are to be performed on the current sample. If the determination is in the affirmative at step 238, the LFO is updated at step 239 and interpolating operation is performed on the volume and panning parameters at step 240, and then the volume levels of the data of the three channels are updated at step 241. These operations complete the waveform formation for the current sample, and the program goes to step 242.

If answered in the negative at the above-mentioned step 238, it means that the current sample is not to be subjected to the LFO updating operation etc. and hence the waveform formation for the current sample has been completed, and the program goes to step 242. At step 242, a determination is made as to whether the waveform forming calculation process has been completed for all the samples, i.e., whether there is any other sample to be processed, the above-mentioned operations at and after step 232 are repeated after incrementing the sample counter SN by one.

If the current AEG value is smaller than the key-off level as determined at the above-mentioned step 237, the program branches to a key-off process of step 244, where the waveform amplitude is attenuated rapidly at a damp rate of FIG. 25A so that the waveform forming process is completed for the "i" channel.

According to the modified embodiment of FIG. 20, the AEG and LFO updating operations of steps 236 and 239, volume and panning value interpolating operation of step 240, and volume level calculations of step 241 are executed once for every eight samples, with the result that the calculating loads of the CPU can be substantially lessened as compared to the embodiment shown in FIGS. 18A and 18B.

In FIG. 20, there is shown another modified embodiment of the waveform forming calculation process for the "i" channel, where operations of steps 261 to 266 are the same as those of the above-mentioned steps 231 to 236 in FIG. 20, operations of steps 267 to 269 are the same as those of the above-mentioned steps 239 to 241, operation of step 270 is the same as that of the above-mentioned step 237, and operations of steps 271 to 273 are the same as those of the above-mentioned steps 242 to 244. Thus, detailed contents of these steps in FIG. 21 will not be described here to avoid unnecessary duplication.

Figure 21:
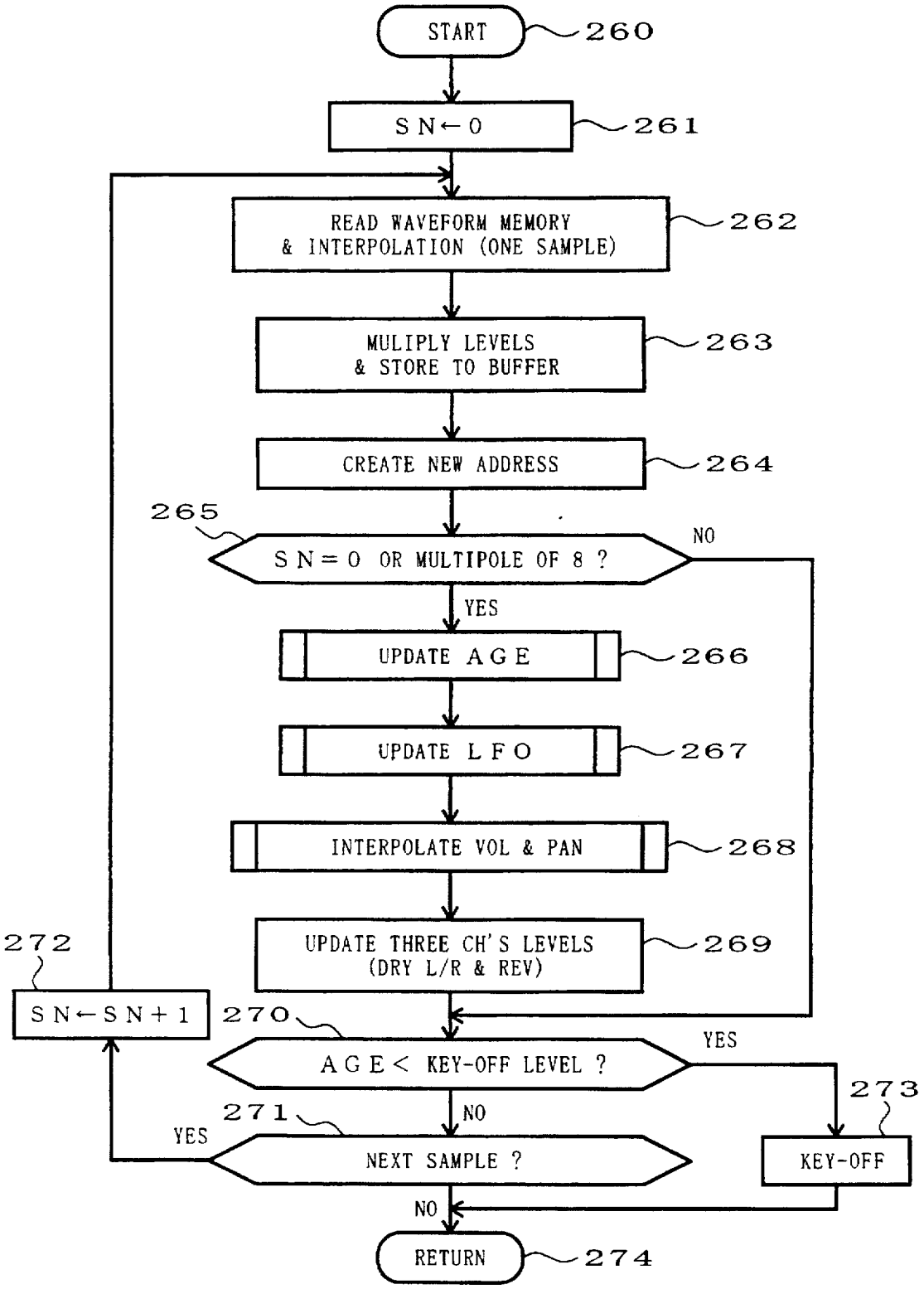
FIG. 21 is a flowchart illustrating still another embodiment of the waveform forming calculation process.

According to the modified embodiment of FIG. 21, if it is determined at step 265 that the current sample is not to be subjected to the EG and LFO calculations, the program jumps to step 270 to further determine whether the current AEG value is smaller than the key-off level. If, on the other hand, the current sample is to be subjected to the EG and LFO calculations as determined at step 265, AEG and LFO updating operations of steps 266 and 267, volume and panning value interpolating operation of step 268, and volume level calculations of step 269 are executed in secession.

That is, in contrast to the embodiment of FIG. 20 where the AEG updating operation of step 236 is performed separately from the LFO updating operation of step 239, volume and panning parameter interpolating operation of step 240 and volume level calculations of step 241 and it is determined after the AEG updating operation whether the current AEG value is smaller than the key-off level, the embodiment of FIG. 21 is arranged in such a manner that these operations are performed collectively or successively and the AEG value determination follows these successive operations. With such an arrangement, the calculating loads or amounts of the CPU in the embodiment of FIG. 21 can be reduced substantially as compared to the above-described embodiment of FIG. 18B, although they are slightly greater than in the FIG. 20 embodiment.

Whereas these embodiments are arranged to reduce the calculating amounts by performing the updating operations of the AEG, LFO, etc. once for each predetermined plurality of samples, whether or not the EG calculation should be effected or not may be determined depending on which of the waveform segments the current sample belongs to. For example, the EG calculation may be effected only for samples in the attack and decay segments, and the EG calculation may be omitted for samples in the sustain segment because the samples in the sustain segment are in a constant state. By thus omitting the EG calculation, the necessary calculating frequency can also be lowered.

Figure 22:
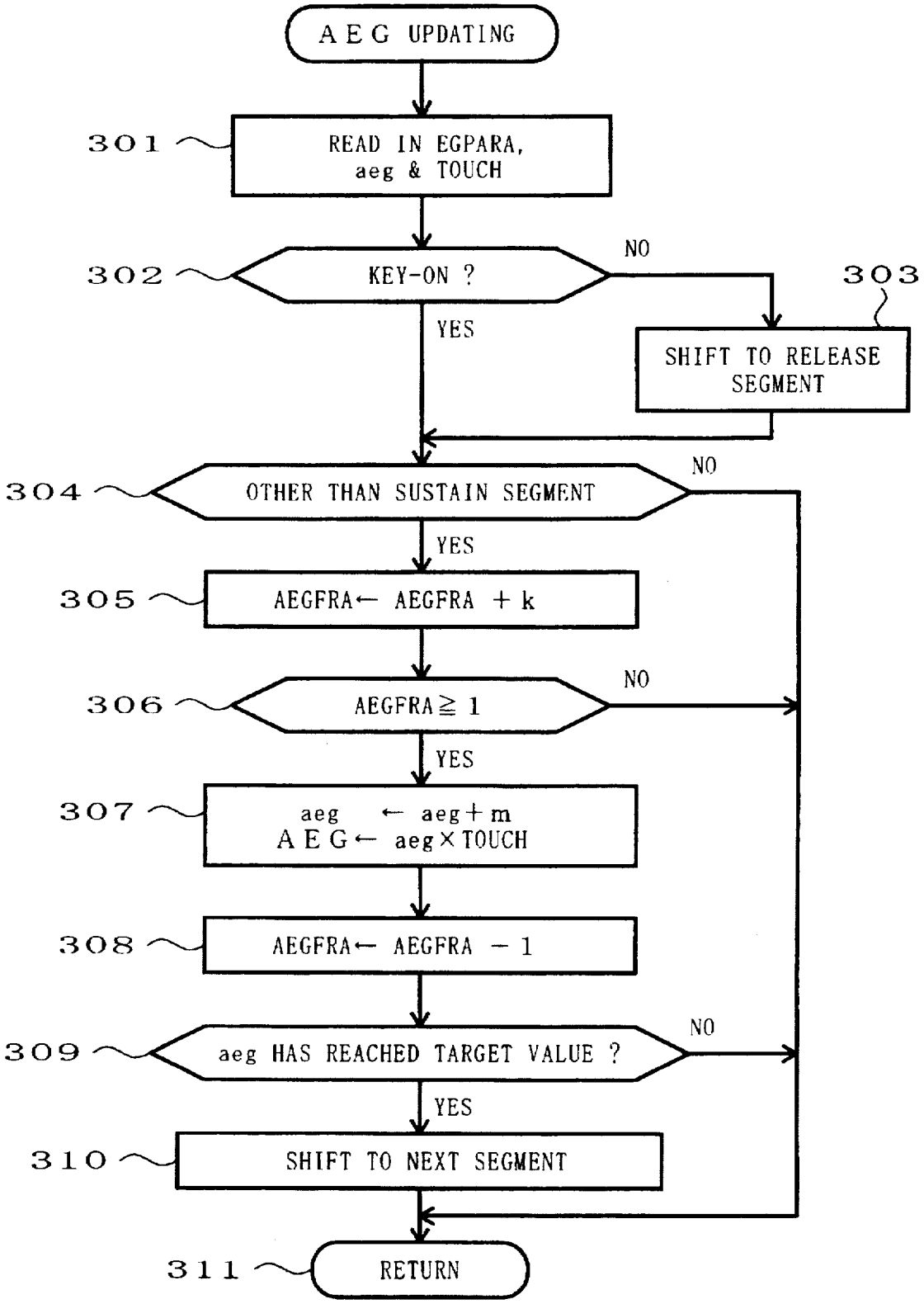
FIG. 22 is a flowchart illustrating an envelope waveform calculating operation.

Next, a detail of the AEG updating operation (step 215 of FIG. 18B, step 236 of FIG. 20 and step 266 of FIG. 21) will be described with reference to FIG. 22. Upon start of the AEG updating operation, EG parameter (EGPARA), current value of the amplitude EG (aeg) and performance touch information (TOUCH) are read in at step 301. This EG controlling information typically comprises respective durations and target values (EGMAXlevel and SUSlevel) of the individual waveform segments and attack rate (ATKrate), decay rate (DCrate) and release rate (RLSrate) of a tone to be generated through the channel in question.

Then, at next step 302, it is determined whether the current state is a key-on state. If answered in the negative at step 302, it means that the current state is a key-off state, and the control goes to step 303 to shift to the release segment. If the current state is a key-on state, the control proceeds to step 304, where it is further determine whether the current segment is other than a sustain segment. If answered in the negative at step 304, i.e., if the current segment is a sustain segment, it means that the AEG is in a constant state, and thus the AEG updating operation is terminated immediately. If, on the other hand, the current segment is other than a sustain segment as determined at step 304, the program proceeds to step 305 to effect the AEG updating.

Since the present invention treats the EG value as an integral number although the EG parameter such as a rate value of each individual EG segment is stored in a real number, the AEG updating is performed in the following manner. Namely, settings are made in the embodiment such that: if f>0, m=n+1, and k=RATE/(n+1); and if f=0, m=n, and k=RATE/n=1, where RATE represents a rate value of the current segment, and n and f represent the integral and decimal portions, respectively, of the rate value . By accumulating the value "k", and adding integer value "m" to the current AEG value (aeg) each time the accumulated value exceeds "1", the AEG is updated. By so doing, decimal roundup value "m" can be added with a probability of RATE/m, and this is equivalent to the AEG value being updated by adding "m·(RATE/m)=RATE" to the current AEG value (aeg).

To this end, the value "k" is added at step 305 into an aeg fraction register AEGFRA which is a register for accumulating the value "k" as mentioned. At step 306, a determination is made as to whether the current value stored in the fraction register AEGFRA has become greater than "1". With a negative determination, the AEG updating operation ends without updating the current AEG value. Once the current value in the fraction register AEGFRA exceeds "1" and the determination becomes affirmative at step 306, the program proceeds to step 307, where m=(integer portion n+1 of the rate value of the current segment) is added to the current AEG value (aeg) to obtain a new AEG value (aeg) and the new AEG value is multiplied by the performance touch information TOUCH so as to obtain a updated AEG value.

At next step 308, the value in the fraction register AEGFRA is decremented by one to prepare for next execution of the "k" accumulation, and then it is determined at step 309 whether the AEG value (aeg) has reached the target value (EGMAXlevel in the case of the attack segment and SUSlevel in the case of the decay segment). If answered in the affirmative at step 309, the program shifts to a next waveform segment at step 310; otherwise, the AEG updating operation ends without performing the operation of step 310.

Figure 23:
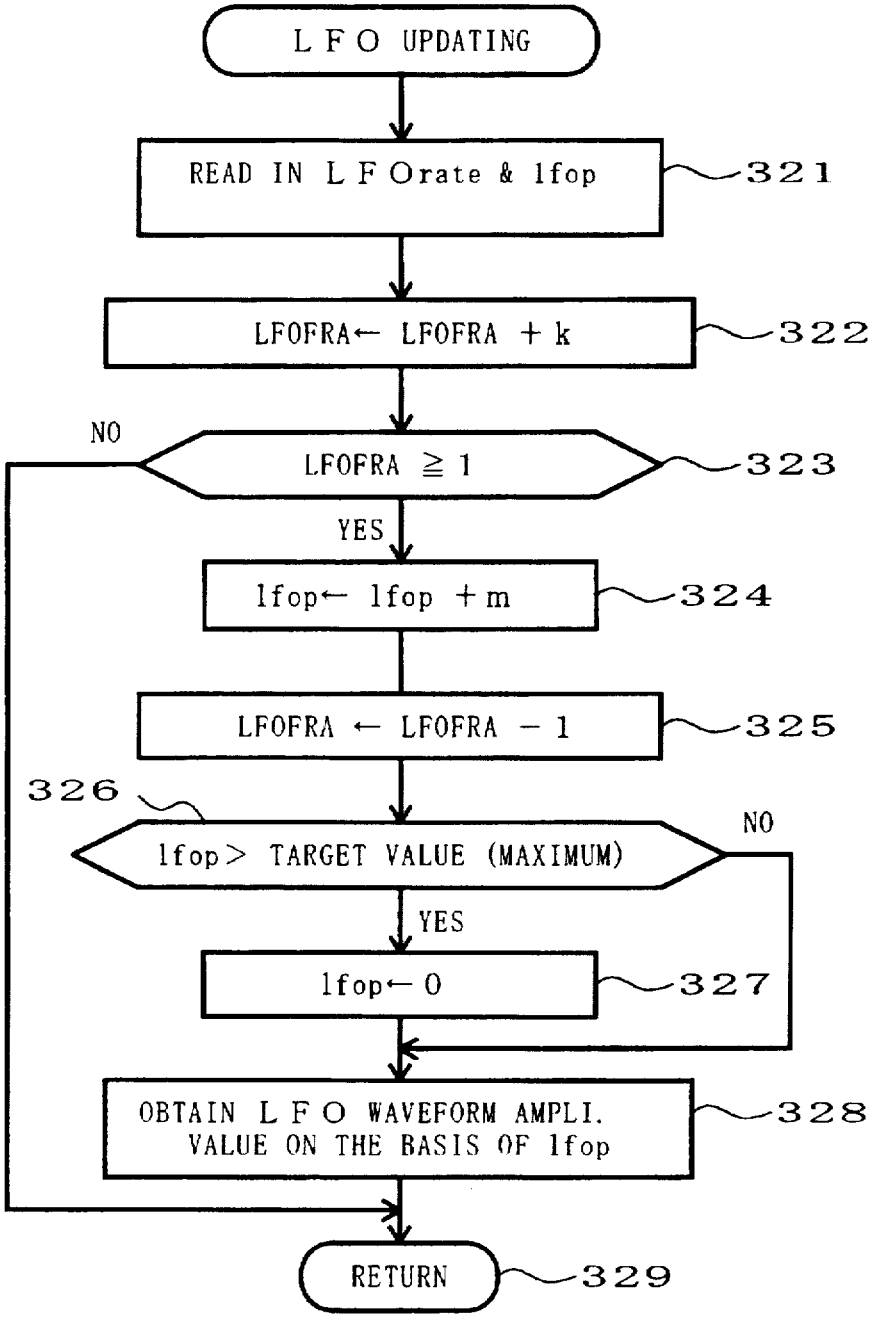
FIG. 23 is a flowchart illustrating a low-frequency-signal envelope waveform calculating operation.

Next, a detail of the LFO updating operation (step 217 of FIG. 18B, step 239 of FIG. 20 and step 267 of step 21) will be described with reference to FIG. 23. Since the present invention treats the LFO parameter as an integral number although it is stored in a real number, the LFO updating is performed with probability calculations similarly to the EG value. First, at step 321, the currently stored LFO controlling data, i.e., LFO rate (LFOrate) and current LFO phase value (lfop) are read in.

After that, similarly to the EG value, settings are made such that: if f>0, m=n+1, and k=LFOrate/(n+1); and if f=0, m=n, and k=LFOrate/n=1, where LFOrate represents the read-out LFO rate value, and n and f represent the integral and decimal portions, respectively, of the rate value. By accumulating the value "k", and adding integer value "m" to the current LFO value (lfop) each time the accumulated value exceeds "1", the LFO value is updated.

To this end, the value "k" is added at step 322 into an lfop fraction register LFOFRA. At next step 323, a determination is made as to whether the current value stored in the fraction register LFOFRA has become greater than "1". With a negative determination, the LFO updating operation ends without updating the current LFO value. Once the current value in the fraction register LFOFRA exceeds "1" and the determination becomes affirmative at step 323, the program proceeds to step 324, where m=(integer portion n+1 of LFOrate) is added to the current LFO value (lfop) to obtain a new LFO value (lfop).

At next step 325, the value in the fraction register LFOFRA is decremented by one to prepare for next execution of the operations, and then it is determined at step 326 whether the current LFO value (lfop) has reached a target value. If answered in the affirmative at step 326, the program resets the current LFO value (lfop) to "0". In this way, an LFO value of a sawtooth waveform is formed as shown in FIG. 25B. Then, at step 328, an amplitude value of an predetermined LFO waveform is obtained by referring to a table or calculations on the basis of the current LFO phase value (lfop).

A description has been give above about a preferred embodiment of the method where LFO values of a sawtooth waveform as shown in FIG. 25B are generated to be used as a modulating or various modulating waveforms are generated on the basis of such sawtooth waveform LFO values. Alternatively, LFO values of a desired modulating waveform may be obtained through other direct arithmetic operations or by just sequentially referring to a predetermined modulating waveform table.

Figure 24:
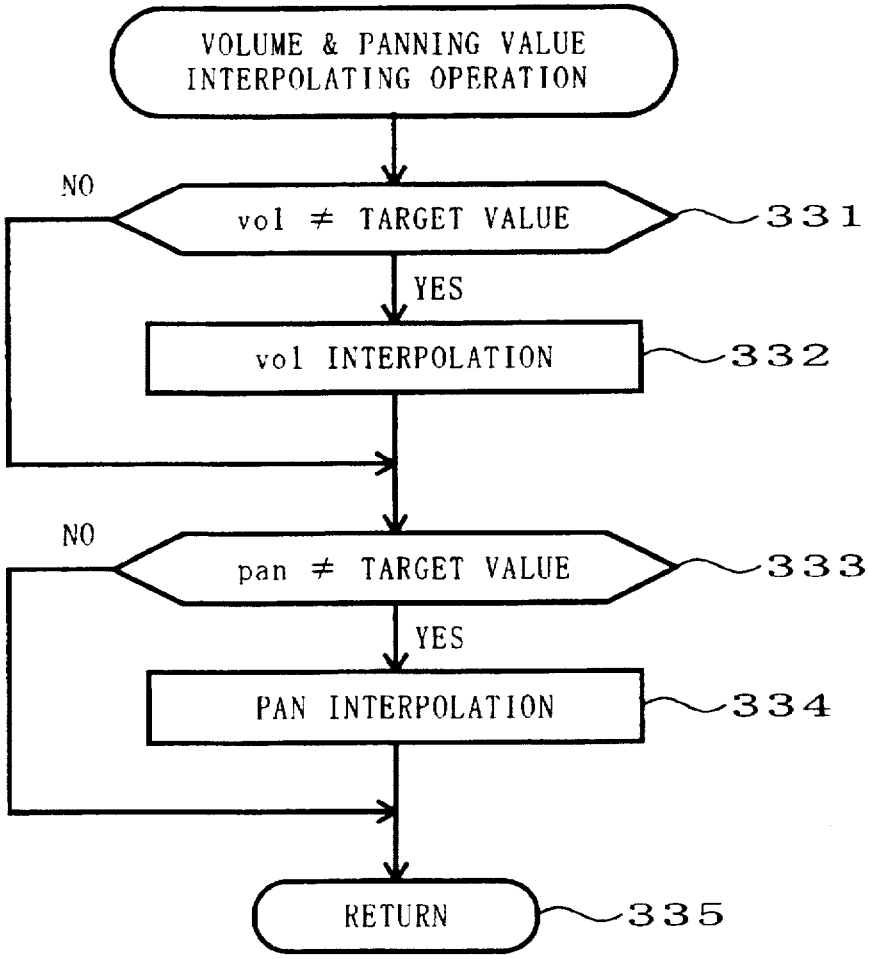
FIG. 24 is a flowchart illustrating a volume and panning value interpolating operation.

Next, a detail of the volume and panning value interpolating operation (step 218 of FIG. 18B, step 240 of FIG. 20 and step 268 of step 21) will be described with reference to FIG. 24. The volume and panning information is set through the user's operation. At step 331, it is determined whether the current value of the volume information (vol) has not yet reached a user-set target value. If the current volume information value (vol) has reached the user-set target value, a negative determination results at step 331, and the program goes to step 333; if the current volume information value (vol) has not reached the user-set target value, an affirmative determination results at step 331, and the program goes to step 332 to execute an interpolation operation of the vol data to set the interpolated data as new vol data.

At step 333, it is determined whether the current value of the panning information (pan) has not reached a user-set target value. If the current pan information value (vol) has reached the user-set target value, a negative determination results at step 333, and the program terminates the operations; if the current panning information value (pan) has not reached the user-set target value, an affirmative determination results at step 333, and the program goes to step 334 to execute an interpolation operation of the panning data to set the interpolated data as new pan data.

While the embodiment has been described above as activating the tone generator task 20 in response to the OUTPUT READY message generated at the end of the one-frame reproduction by the output driver, it may of course be arranged differently. For example, the tone generator task 20 may be activated at an intermediate point in the one-frame reproduction because the item (5) to item (7) operations can be completed in a shorter time than the one-frame time. Further, in stead of the tone generator task 20 being activated for each frame having a constant time length, the task 20 may be activated at a time point when it is detected that the waveform data set in the output driver has decreased below a predetermined quantity.

Furthermore, the waveform calculating method of the present invention may be implemented in not only a software tone generator but also a dedicated tone generating device provided within an electronic musical instrument, in response to the OUTPUT READY message.

Moreover, the above-described synthesization of the formed waveform data and externally input waveform data, and insertion of the externally input waveform data in an intermediate stage of the waveform forming calculation process may also be applied not only to a software tone generator but also to a dedicated tone generating device provided within an electronic musical instrument.

Furthermore, while the embodiment has been described as performing the item (5), (6), (7), (1), (2) and (3) operations sequentially in the mentioned order, these operations may be performed in any other order.

In addition, the above-described waveform calculating operation at item (3) may be divided into a plurality of sections to be performed dividedly, rather than successively as in the above-described embodiment.

Moreover, while the preferred embodiments have been described as collectively executing tone assignment and setting of the tone generator registers in the MIDI event interrupt process, only the tone assignment may be executed in the interrupt process, or the interrupt process may only perform the operation to read the occurred MIDI event into buffers. In this case, the tone assignment and setting of the tone generator registers may be performed in the tone generator processing rather than in the MIDI event interruptprocess. Alternatively, they may be performed in a timer interrupt process separate from the above-mentioned MIDI event interrupt process.

Further, the above-mentioned interrupt process may be performed for any other performance information processing, rather than being limited to the tone assignment and read-in operations.

In addition, the tone generating method of the present invention should not be understood as being limited to the waveform-memory-based method alone, but may be based on any other principle such as the FM, physical mode or ADPCM.

With the present invention having been described so far, the waveform forming calculations can be executed in a stable manner in parallel with an optional general-purpose operating system.

Further, the present invention advantageously permits output waveform data to be output promptly in response to a request from the waveform reproduction section.

Furthermore, with the present invention, the software tone generator is allowed to execute a tone color controlling process on externally input waveform data.

Furthermore, even where the tone generator process can not be executed to a sufficient degree due to an increased amount of processing responsive to occurrence of performance information, the present invention can make up for the deficiency at some other time, and hence the tone generator processing can be effectively stabilized.

Moreover, increased processing amounts at the time of performance information can be dispersed within idle times, and thus it is possible to effectively avoid a temporary increase in the processing amounts.

Furthermore, by performing the EG waveform and LFO calculations intermittently, the present invention can reduce the necessary calculating amounts for waveform formation and thus effectively lessen the processing loads for the waveform formation.

What is claimed is:

1. A tone generating method comprising:

a first step of issuing generation instructions to generate a plurality of designated tones;

a second step of assigning the designated tones to respective tone generating channels designated from among a plurality of tone generating channels, and writing controlling data for the designated tones into channel registers of the respective designated tone generating channels for storage therein;

a third step of issuing calculation-start instructions at predetermined intervals;

a fourth step of, in response to each said calculation-start instructions issued by said third step, sequentially performing tone forming calculations for the designated tone generating channels, so as to arithmetically form waveform data for plural samples for each of the designated tone generating channels on the basis of the controlling data stored in said channel register of said channel;

a fifth step of, for each of the samples, mixing the waveform data formed for the designated tone generating channels by said fourth step so as to form mixed sample data; and a sixth step of converting the mixed sample data for each of the plural samples into an analog signal every sampling cycle, wherein in said tone forming calculations, said fourth step, forms, for each of the designated tone generating channels, the waveform data for the plural samples on the basis of one readout of the controlling data from said channel register and writes the controlling data into said channel register after the formation of the waveform data.

2. A tone generating method as defined in claim 1 which further comprises a seventh step of issuing an on-the-way calculation-start instruction in accordance with the generation instruction issued by said first step for each of the designated tones, and wherein in response to the on-the-way calculation-start instruction, said fourth step forms the waveform data for plural samples that correspond to a section from an end point of a last-formed waveform to a time point when the generation instruction is issued by said first step.

3. A tone generating method comprising:

a first step of issuing generation instructions to generate a plurality of designated tones, a second step of assigning designated tones to respective tone generating channels designated from among a plurality of tone generating channels and writing controlling data for the designated tones into channel registers of the designated tone generating channels for storage therein;

a third step of issuing calculation-start instructions at predetermined intervals;

a fourth step of, in response to each said calculation-start instruction issued by said third step, arithmetically forming waveform data for plural samples for each of the designated tone generating channels on the basis of the controlling data stored in said channel register of said channel;

a fifth step of, for each of the plural samples, mixing the waveform data formed for the designated tone generating channels by said fourth step, so as to form mixed sample data for each of the plural samples;

a sixth step of converting the mixed sample data for the plural samples into an analog signal every sampling cycle; and wherein said fourth step performs arithmetic formation of the waveform data in accordance with a predetermined condition giving priority to at least one of the channels currently generating a tone with a higher volume than the other channel.

4. A tone generating method as defined in claim 3 which further comprises a seventh step of setting a predetermined limit period, and an eighth step of determining whether calculations for all designated tone generating channels will be completed within the predetermined limit period, and, if it is determined that the calculations for all designated tone generating channels will not be completed within the predetermined limit period, instructing that a tone should be muffled in any of the tone generating channels.

5. A tone generating method comprising:

a first step of issuing generation instructions to generate a plurality of designated tones;

a second step of assigning the designated tones to respective tone generating channels designated from among a plurality of tone generating channels, and writing controlling data for the designated tones into channel registers of the respective designated tone generating channels for storage therein;

a third step of determining calculation-processing order across the designated tone generating channels in accordance with respective importance of the tones to be generated in the designated tone generating channels;

a fourth step of issuing calculation-start instructions at predetermined intervals;

a fifth step of arithmetically forming waveform data for plural samples on the basis of the controlling data stored in the channel registers of the designated tone generating channels, in response to the calculation-start instructions issued by said fourth step;

a sixth step of, for each of the plural samples, mixing the waveform data formed for the channels, so as to form mixed sample data for the plural samples; and a seventh step of converting the mixed sample data for the plural samples into into an analog signal every sampling cycle, wherein said fifth step performs calculations for forming the waveform data for the designated tone generating channels in accordance with the calculation-processing order determined by said third step, and when it is likely that the calculations for forming the waveform data by said fifth step will not be completed within a predetermined time and the analog signal converted by said seventh step will be broken off, the calculations for forming the waveform data are discontinued at a time point when they are being performed on one of the channels in the calculation-processing order, so as to prevent the analog signal from being broken off.

6. A tone generating method for execution on a computing unit, comprising:

an input step of inputting performance information;

a waveform formation step of, on the basis of the performance information inputted during a predetermined period, arithmetically forming waveform data corresponding to the predetermined period;

an output step of outputting, every sampling cycle, one sample of the waveform data corresponding to the predetermined period;

a waveform data delivery step of supplying said output step with the waveform data corresponding to the predetermined period formed by said waveform formation step; and a request step of detecting when output of the waveform data by said output step has progressed, so as to request another supply of the waveform data from said waveform data delivery step, wherein said waveform data delivery step is executed in response to a request by said request step and said waveform formation step is executed after said delivery step.

7. A tone generating method for execution on a computing unit, comprising:

an input step of inputting performance information;

a waveform formation step of, on the basis of the performance information inputted during a predetermined period, arithmetically forming waveform data corresponding to the predetermined period, said waveform formation step forming plural successive samples of said waveform data;

a waveform synthesis step of inputting external waveform data corresponding to the predetermined period, and combining the external waveform data and the waveform data arithmetically formed by said waveform formation step so as to form synthesized waveform data for the predetermined period;

a waveform processing step of applying signal processing to the synthesized waveform data for the predetermined period, said waveform processing step applying said signal processing to the plural samples of said synthesized waveform data; and an output step of outputting, every sampling cycle, one sample of the synthesized waveform data.

8. A tone generating device comprising:

a memory for storing a tone generator processing program and a performance processing program;

supply means for supplying performance information;

a register for storing control information;

calculation means for executing the tone generator processing program and performance processing program, said calculation means normally executing the tone generator processing program to collectively form waveform data for plural sampling periods on the basis of the control information, wherein when the performance information is supplied by said supply means, said calculation means temporarily interrupts execution of the tone generator processing program so as to execute the performance processing program to thereby create control information corresponding to the supplied performance information and store the created control information in said register, and, upon completion of the performance processing program, resumes the tone generator processing program at a point where the tone generator processing program is interrupted; and tone output means for, on the basis of the waveform data formed by the tone generator processing program, generating a corresponding tone at timing later than formation of the waveform data by said calculation means.

9. A tone generating method for execution on a computing unit, comprising:

an input step of inputting performance information;

a waveform formation step of, on the basis of the performance information inputted during a predetermined period, arithmetically forming waveform data corresponding to the predetermined period;

an output step of outputting, every sampling cycle, one sample of the waveform data corresponding to the predetermined period;

a waveform data delivery step of supplying said output step with the waveform data corresponding to the predetermined period formed by said waveform formation step; and a request step of detecting when output of the waveform data by said output step has progressed, so as to request another supply of the waveform data from said waveform data delivery step, wherein said waveform formation step performs a tone parameter calculating operation in an intermittent fashion, said waveform data supply step is executed in response to a request by said request step and said waveform formation step is executed after said delivery step.

10. A tone generating method for execution on a computing unit, comprising:

an input step of inputting performance information;

a waveform formation step of, on the basis of the performance information inputted during a predetermined period, arithmetically forming plural successive samples of waveform data corresponding to the predetermined period;

a waveform synthesis step of inputting external waveform data corresponding to the predetermined period, and combining the external waveform data and the waveform data arithmetically formed by said waveform formation step so as to form synthesized waveform data for the predetermined period;

a waveform processing step of applying signal processing to the synthesized waveform data for the predetermined period; and an output step of outputting, every sampling cycle, one sample of the synthesized waveform data, wherein said waveform formation step performs a tone parameter calculating operation in an intermittent fashion.

11. A tone sound generation device comprising:

first means for issuing generation instructions to generate a plurality of designated tones;

second means for assigning the designated tones to respective tone generating channels designated from among a plurality of tone generating channels, and writing controlling data for the designated tones into channel registers of the respective designated tone generating channels for storage therein;

third means for issuing calculation-start instructions at predetermined intervals;

fourth means for, in response to each said calculation-start instruction issued by said third means, sequentially performing tone forming calculations for the designated tone generating channels, so as to arithmetically form waveform data for plural samples for each of the designated tone generating channels on the basis of the controlling data stored in said channel register of said channel;

fifth means for, for each of the samples, mixing the waveform data formed for the designated tone generating channels by said fourth means so as to form mixed sample data; and sixth means for converting the mixed sample data for each of the plural samples into an analog signal every sampling cycle, wherein in said tone forming calculations, said fourth means forms, for each of the designated tone generating channels, the waveform data for the plural samples on the basis of one readout of the controlling data from said channel register and writes the controlling data into said channel register after the formation of the waveform data.

12. A tone generation device as defined in claim 11 which further comprises seventh means for issuing an on-the-way calculation-start instruction in accordance with the generation instruction issued by said first means for each of the designated tones, and wherein in response to the on-the-way calculation-start instruction, said fourth means forms the waveform data for plural samples that correspond to a section from an end point of a last-formed waveform to a time point when the generation instruction is issued by said first means.

13. A sound generation apparatus comprising:

a processor device that executes first and second programs;

a memory device that stores the programs to be executed by the processor device;

an input device that inputs a generation instruction to generate a designated sound;

a register device that stores control data for controlling a sound to be generated in a sound generation channel, said control data being stored separately in said register device for each of a plurality of said sound generation channels; and an output device that outputs generated sound waveform data every predetermined sampling cycle, wherein said processor device executes said first program which is directed to a process of, in response to an input of said generation instruction via said input device, assigning the designated sound to one of the sound generation channels and storing said control data corresponding to said designated sound into said register device in correspondence with the assigned channel, and wherein said processor device further executes said second program which is directed to processes of:

issuing calculation-start instructions at predetermined intervals;

in response to each said calculation-start instruction performing sound forming calculations for said channels so as to arithmetically form waveform data for plural samples for each of the channels on the basis of the control data stored in said register device within a time shorter than a time corresponding to a total number of sampling cycles necessary for said plural samples to be formed, said sound forming calculations being performed in accordance with a predetermined condition giving priority to at least one of the channels currently generating a tone with a higher volume than the other channel, and mixing for each predetermined sample point, the samples of the waveform data formed for the individual channels so as to form mixed sample data for each said sample point;

and wherein said output device outputs the mixed sample data of successive sample points every sampling cycle as said generated sound waveform data.

14. A sound generation apparatus as defined in claim 13 wherein said second program executed by said processor device is further directed to professes of setting a predetermined limit period, and determining whether calculations for all designated tone generating channels will be completed within the predetermined limit period, and, if it is determined that the calculations for all designated tone generating channels will not be completed within the predetermined limit period, instructing that a tone should be muffled in any of the tone generating channels.

15. A tone generation device comprising:

first means for issuing generation instructions to generate a plurality of designated tones;

second means for assigning the designated tones to respective tone generating channels designated from among a plurality of tone generating channels, and writing controlling data for the designated tones into channel registers of the respective designated tone generating channels for storage therein;

third means for determining calculation-processing order across the designated tone generating channels in accordance with respective importance of the tones to be generated in the designated tone generating channels;

fourth means for issuing calculation-start instructions at predetermined intervals;

fifth means for arithmetically forming waveform data for plural samples on the basis of the controlling data stored in the channel registers of the designated tone generating channels, in response to the calculation-start instructions issued by the fourth means;

sixth means for, for each of the plural samples, mixing the waveform data formed for the channels, so as to form mixed sample data for the plural samples; and seventh means for converting the mixed sample data for the plural samples into an analog signal every sampling cycle, wherein said fifth means performs calculations for forming the waveform data for the designated tone generating channels in accordance with the calculation-processing order determined by said third means, and when it is likely that the calculations for forming the waveform data by said fifth means will not be completed within a predetermined time and the analog signal converted by said seventh means will be broken off, the calculations for forming the waveform data are discontinued at a time point when they are being performed on one of the channels in the calculation-processing order, so as to prevent the analog signal from being broken off.

16. A tone generation device comprising:

supply means for supplying performance information;

main means for arithmetically forming waveform data for plural sampling periods in a collective, successive fashion;

interrupt means for, when the performance information is supplied by said supply means, temporarily interrupting said main means so that said main means performs a predetermined input operation instead of forming the waveform data for receiving the supplied performance information, and upon completion of the input operation, resuming said main means at a point where said main means is interrupted; and tone generation means for, on the basis of the waveform data formed by said main means, generating a corresponding tone at timing later than a time point when the waveform data is arithmetically formed by said interrupt means, wherein said main means includes a performance information processing means to create tone controlling data on the basis of the performance information having undergone the input operation, and tone generator processing means to arithmetically form the form waveform data on the basis of the tone controlling data.

17. A sound generation apparatus comprising:

a processor device which executes a predetermined operating system, and plural programs executed on the operating system, said plural programs including an application program, a sound generating program and a task control program;

a memory device that stores the programs to be executed by the processor device; and an output device that outputs generated sound waveform data every predetermined sampling cycle, wherein said processor device executes said sound generating program which is directed to a process of forming waveform data for a predetermined number of samples every predetermined period, in an arithmetic manner, in response to an instruction to venerate a sound from said application program executed on the operating system, wherein said output device outputs each of successive samples of said formed waveform data at every sample cycle, and generates a trigger signal to request a task switching once for a plurality of sampling cycles, and wherein said processor device further executes said task control program which is directed to a process of, in response to said trigger signal, controlling a task switching operation between execution of said operating system and execution of forming of said waveform data during said predetermined period.

18. A tone generation device comprising:

input means for inputting performance information;

waveform formation means for, on the basis of the performance information inputted during a predetermined period, arithmetically forming waveform data corresponding to the predetermined period;

output means for outputting, every sampling cycle, one sample of the waveform data corresponding to the predetermined period;

waveform data delivery means for supplying said output means with the waveform data corresponding to the predetermined period formed by said waveform formation means; and request means for detecting when output of the waveform data by said output means has progressed, so as to request another supply of the waveform data from said waveform data delivery means, wherein said waveform data delivery means is executed in response to a request by said request means and said waveform formation means is executed after said delivery means.

19. A sound generation apparatus comprising:

a processor device that executes a sound generating program;

a memory device that stores the program to be executed by the processor device;

an input device for inputting performance information;

an output device that outputs generated sound waveform data every predetermined sampling cycle, wherein said processor device executes said sound generating program which is directed to processes of, on the basis of the performance information inputted during a predetermined period, arithmetically forming waveform data corresponding to the predetermined period;

inputting external waveform data corresponding to the predetermined period, combining the external waveform data and the waveform data arithmetically formed by said waveform formation means so as to form synthesized waveform data for the predetermined period; and applying signal processing to the synthesized waveform data for the predetermined period; and wherein said output device outputs, every sampling cycle, one sample of the combined and processed waveform data as said generated sound waveform data.

20. A sound generation apparatus comprising:

a processor device that executes a sound generating program;

a memory device that stores the program to be executed by the processor device;

an input device for inputting performance information;

an output device that outputs a generated sound waveform data every predetermined sampling cycle, wherein said processor device executes said sound generating program which is directed to processes of:

on the basis of the performance information inputted during a predetermined period, performing calculations over a plurality of stages so as to arithmetically form waveform data;

inputting external waveform data; and inserting the inputted external waveform data in one of the stages of said calculations.

21. A sound generation apparatus comprising:

a processor which executes a predetermined operating system, and plural programs executed on the operating system, said plural programs including an application program, a sound generating program and a task control program;

a memory device that stores the programs to be executed by the processor device; and an output device that outputs a generated sound waveform data every predetermined sampling cycle, wherein said processor device executes said sound generating program which is directed to a process of forming waveform data for a predetermined number of samples every predetermined period, in an arithmetic manner, on the basis of an instruction to generate a sound from the application program executed on the operating system, and wherein said output device outputs each of successive samples of said formed waveform data at every sampling cycle, and generates a trigger signal to request a task switching once for a plurality of the sampling cycles, and wherein said processor device further executes said task control program which is directed to a process of, in response to said trigger signal, controlling a task switching operation between execution of said operating system and execution of said sound generating program during said predetermined period, and wherein said processor device executes said sound generating program which is further directed to a process of calculating tone parameters in an intermittent fashion during the process of forming said waveform data, said calculated tone parameters being used for forming said waveform data.

22. A tone generation device comprising:

input means for inputting performance information;

waveform formation means for, on the basis of the performance information inputted during a predetermined period, arithmetically forming waveform data corresponding to the predetermined period;

output means for outputting, every sampling cycle, one sample of the waveform data corresponding to the predetermined period;

waveform data delivery means for supplying said output means with the waveform data corresponding to the predetermined period formed by said waveform formation means; and request means for detecting when output of the waveform data by said output means has progressed, so as to request another supply of the waveform data from said waveform data delivery means, wherein said waveform formation means performs a tone parameter calculating operation in an intermittent fashion, said waveform data supply means is executed in response to a request by said request means and said waveform formation means is executed after said delivery means.

23. A sound generation apparatus comprising:

a processor device that executes a sound generating program;

a memory device that stores the program to be executed by the processor device;

an input device for inputting performance information;

an output device that outputs a generated sound waveform data every predetermined sampling cycle, wherein said processor device executes said sound generating program which is directed to processes of:

on the basis of the performance information inputted during a predetermined period, arithmetically forming waveform data corresponding to the predetermined period;

calculating tone parameters in an intermittent fashion during forming of said waveform data, said calculated tone parameters being used for forming said waveform data, inputting external waveform data corresponding to the predetermined period, and combining the external waveform data and the formed waveform data so as to obtain combined waveform data for the predetermined period;

applying a predetermined sound processing to the combined waveform data for the predetermined period; and wherein said output device outputs, every sampling cycle, one sample of the combined and processed waveform data as said venerated sound waveform data.

24. A machine-readable recording media containing instructions for causing said machine to perform a method of generating a tone, said method comprising:

a first step of issuing generation instructions to generate a plurality of designated tones;

a second step of assigning the designated tones to respective tone generating channels designated from among a plurality of tone generating channels, and writing controlling data for the designated tones into channel registers of the respective designated tone generating channels for storage therein;

a third step of issuing calculation-start instructions at predetermined intervals;

a fourth step of, in response to each said calculation-start instruction issued by said third step, sequentially performing tone forming calculations for the designated tone generating channels, so as to arithmetically form waveform data for plural samples for each of the designated tone generating channels on the basis of the controlling data stored in said channel register of said channel;

a fifth step of, for each of the samples, mixing the waveform data formed for the designated tone generating channels by said fourth step so as to form mixed sample data; and a sixth step of converting the mixed sample data for each of the plural samples into an analog signal every sampling cycle, wherein in said tone forming calculations, said fourth step forms, for each of the designated tone generating channels, formation of the waveform data for the plural samples on the basis of one readout of the controlling data from said channel register and writes the controlling data into said channel register after the formation of the waveform data.

25. A machine-readable recording media containing instructions for causing said machine to perform a method of generating a tone, said method comprising:

a first step of issuing generation instructions to generate a plurality of designated tones;

a second step of assigning designated tones to respective tone generating channels designated from among a plurality of tone generating channels and writing controlling data for the designated tones into channel registers of the designated tone generating channels for storage therein;

a third step of issuing calculation-start instructions at predetermined intervals;

a fourth step of, in response to each said calculation-start instructions issued by said second step, arithmetically forming waveform data for plural samples for each of the designated tone generating channels on the basis of the controlling data stored in said channel register of said channel;

a fifth step of, for each of the plural samples, mixing the waveform data formed for the designated tone generating channels by said third step, so as to form mixed sample data for each of the plural samples;

a sixth step of converting the mixed sample data for the plural samples into into an analog signal every sampling cycle; and wherein said fourth step performs arithmetic formation of the waveform data in accordance with a predetermined condition giving priority to at least one of the channels currently generating a tone with a higher volume than the other channel.

26. A machine-readable recording media containing instructions for causing said machine to perform a method of generating a tone, said method comprising:

a first step of issuing generation instructions to generate a plurality of designated tones;

a second step of assigning the designated tones to respective tone generating channels designated from among a plurality of tone generating channels, and writing controlling data for the designated tones into channel registers of the respective designated tone generating channels for storage therein;

a third step of determining calculation-processing order across the designated tone generating channels in accordance with respective importance of the tones to be generated in the designated tone generating channels;

a fourth step of issuing calculation-start instructions at predetermined intervals;

a fifth step of arithmetically forming waveform data for plural samples on the basis of the controlling data stored in the channel registers of the designated tone generating channels, in response to the calculation-start instructions issued by said fourth step;

a sixth step of, for each of the plural samples, mixing the waveform data formed for the channels, so as to form mixed sample data for the plural samples; and a seventh step of converting the mixed sample data for the plural samples into into an analog signal every sampling cycle, wherein said fifth step performs calculations for forming the waveform data for the designated tone generating channels in accordance with the calculation-processing order determined by said third step, and when it is likely that the calculations for forming the waveform data by said fifth step will not be completed within a predetermined time and the analog signal converted by said seventh step will be broken off, the calculations for forming the waveform data are discontinued at a time point when they are being performed on one of the channels in the calculation-processing order, so as to prevent the analog signal from being broken off.

27. A machine-readable recording media containing instructions for causing said machine to perform a method of generating a tone, said method comprising:

a supply step of supplying performance information;

a main step of arithmetically forming waveform data for plural sampling periods in a collective, successive fashion;

an interrupt step of, when the performance information is supplied by said supply step, temporarily interrupting said main step so as to perform a predetermined input operation for receiving the supplied performance information, and upon completion of the input operation, resuming said main step at a point where said main step is interrupted; and a tone generation step of, on the basis of the waveform data formed by said main step, generating a corresponding tone at timing later than a time point when the waveform data is arithmetically formed by said main step, wherein said main step includes a performance information processing step to create tone controlling data on the basis of the performance information having undergone the input operation, and a tone generator processing step to arithmetically form the form waveform data on the basis of the tone controlling data.

28. A machine-readable recording media containing instructions for causing said machine to perform a method of generating a tone, said method comprising:

an input step of inputting performance information;

a waveform formation step of, on the basis of the performance information inputted during a predetermined period, arithmetically forming waveform data corresponding to the predetermined period;

an output step of outputting, every sampling cycle, one sample of the waveform data corresponding to the predetermined period;

a waveform data delivery step of supplying said output step with the waveform data corresponding to the predetermined period formed by said waveform formation step; and a request step of detecting when output of the waveform data by said output step has progressed, so as to request another supply of the waveform data from said waveform data delivery step, wherein said waveform data delivery step is executed in response to a request by said request step and said waveform formation step is executed after said delivery step.

29. A machine readable media containing instructions for causing said machine to perform a method of generating a tone, said method comprising:

an input step of inputting performance information;

a waveform formation step of, on the basis of the performance information inputted during a predetermined period, arithmetically forming plural successive samples of waveform data corresponding to the predetermined period;

a waveform synthesis step of inputting external waveform data corresponding to the predetermined period, and combining the external waveform data and the waveform data arithmetically formed by said waveform formation step so as to form synthesized waveform data for the predetermined period;

a waveform processing step of applying signal processing to the synthesized waveform data for the predetermined period; and an output step of outputting, every sampling cycle, one sample of the synthesized waveform data.

30. A machine-readable recording media containing instructions for causing said machine to perform a method of generating a tone, said method comprising:

an input step of inputting performance information;

a waveform formation step of, on the basis of the performance information inputted during a predetermined period, arithmetically forming waveform data corresponding to the predetermined period;

an output step of outputting, every sampling cycle, one sample of the waveform data corresponding to the predetermined period;

a waveform data delivery step of supplying said output step with the waveform data corresponding to the predetermined period formed by said waveform formation step; and a request step of detecting when output of the waveform data by said output step has progressed, so as to request another supply of the waveform data from said waveform data delivery step, wherein said waveform formation step performs a tone parameter calculating operation in an intermittent fashion, said waveform data supply step is executed in response to a request by said request step and said waveform formation step is executed after said delivery step.

31. A machine readable media containing instructions for causing said machine to perform a method of generating a tone, said method comprising:

an input step of inputting performance information;

a waveform formation step of, on the basis of the performance information inputted during a predetermined period, arithmetically forming plural successive samples of waveform data corresponding to the predetermined period;

a waveform synthesis step of inputting external waveform data corresponding to the predetermined period, and combining the external waveform data and the waveform data arithmetically formed by said waveform formation step so as to form synthesized waveform data for the predetermined period;

a waveform processing step of applying signal processing to the synthesized waveform data for the predetermined period; and an output step of outputting, every sampling cycle, one sample of the synthesized waveform data, wherein said waveform formation step performs a tone parameter calculating operation in an intermittent fashion.

32. A sound generating method comprising:

a first step of inputting a generation instruction to generate a designated sound;

a second step of, in response to an input of said generation instruction, assigning the designated sound to one of plural sound generating channels and storing control data for the designated sound into a register in correspondence with the assigned channel;

a third step of issuing calculation-start instructions at predetermined intervals;

a fourth step of, in response to each said calculation-start instruction, performing sound forming calculations for said channels so as to arithmetically form plural samples of waveform data for each of the channels, collectively, on the basis of the control data stored in said register, within a time shorter than a time corresponding to a total number of sampling cycles necessary for said plural samples to be formed;

a fifth step of mixing, for each predetermined sample point, the samples of waveform data formed for the individual channels so as to form mixed sample data for said sample point; and a sixth step of sequentially outputting the mixed sample data of successive sample points every sampling cycle.

33. A machine-readable recording media containing a group of instructions to cause said machine to implement a method of generating a sound, said method comprising:

a first step of inputting a generation instruction to generate a designated sound;

a second step of, in response to an input of said generation instruction, assigning the designated sound to one of plural sound generating channels and storing control data for the designated sound into a register in correspondence with the assigned channel;

a third step of issuing calculation-start instructions at predetermined intervals;

a fourth step of, in response to each said calculation-start instruction, performing sound forming calculations for said channels so as to arithmetically form plural samples of waveform data for each of the channels, collectively, on the basis of the control data stored in said register, within a time shorter than a time corresponding to a total number of sampling cycles necessary for said plural samples to be formed;

a fifth step of mixing, for each predetermined sample point, the samples of waveform data formed for the individual channels so as to form mixed sample data for said sample point; and a sixth step of sequentially outputting the mixed sample data of successive sample points every sampling cycle.

34. A tone generating method comprising:

a first step of issuing generation instructions to generate a plurality of designated tones;

a second step of assigning the designated tones to respective tone generating channels designated from among a plurality of tone generating channels, and writing controlling data for the designated tones into channel registers of the respective designated tone generating channels for storage therein;

a third step of issuing calculation-start instructions at predetermined intervals;

a fourth step of, in response to each said calculation-start instruction issued by said third step, sequentially performing tone forming calculations for the designated tone generating channels, so as to arithmetically form waveform data for plural samples for each of the designated tone generating channels on the basis of the controlling data stored in said channel register of said channel;

a fifth step of, for each of the samples, mixing the waveform data formed for the designated tone generating channels by said fourth step so as to form mixed sample data;

a sixth step of storing the mixed sample data for plural samples in a buffer memory; and a seventh step of converting the mixed sample data for each of the plural samples into an analog signal every sampling cycle, wherein in said tone forming calculations, said fourth step, for each of the designated tone generating channels, the waveform data for the plural samples on the basis of one readout of the controlling data from said channel register and writes the controlling data into said channel register after the formation of the waveform data.

35. A sound generation apparatus comprising:

a processor device that executes first and second programs;

a memory device that stores the programs to be executed by the processor device;

an input device that inputs a generation instruction to generate a designated sound;

a register device that stores control data for controlling a sound to be generated in a sound generation channel, said control data being stored separately in said register device for each of a plurality of said sound generation channels; and an output device that outputs generated sound waveform data every predetermined sampling cycle, wherein said processor device executes said first program which is directed to a process of, in response to an input of said generation instruction via said input device, assigning the designated sound to one of the sound generation channels and storing said control data corresponding to said designated sound into said register device in correspondence with the assigned channel, and wherein said processor device further executes said second program which is directed to processes of:

issuing calculation-start instructions at predetermined intervals, in response to each said calculation-start instruction, performing sound forming calculations for said channels so as to arithmetically form plural samples of waveform data for each of the channels on the basis of the control data stored in said register device, within a time shorter than a time corresponding to a total number of sampling cycles necessary for said plural samples to be formed, mixing, for each predetermined sample point, the samples of waveform data formed for the individual channels so as to form mixed sample data for said sample point, and storing the mixed sample data of successive sample points in a buffer storage, and wherein said output device outputs every sampling cycle, the mixed sample data of successive sample points from said buffer storage, as said generated sound waveform data.

36. A sound generation apparatus as defined in claim 35 wherein said second program executed by said processor device is further directed to a process of issuing an on-the-way calculation-start instruction in accordance with the generation instruction inputted via said input device, and wherein said process of performing forms, in response to the on-the-way calculation-start instruction, plural samples of waveform data that correspond to a section from an end point of a last-formed waveform to a time point when the generation instruction is inputted via said input device.

* * * * *